US008231160B2

(12) United States Patent
McEnaney

(10) Patent No.: US 8,231,160 B2
(45) Date of Patent: Jul. 31, 2012

(54) RACK FOR CARRYING A HOSE

(76) Inventor: Edward McEnaney, Hicksville, NY (US)

( * ) Notice: Subject to any disclaimer, the term of this patent is extended or adjusted under 35 U.S.C. 154(b) by 197 days.

(21) Appl. No.: 12/298,390

(22) PCT Filed: Apr. 19, 2007

(86) PCT No.: PCT/US2007/009528

§ 371 (c)(1), (2), (4) Date: Oct. 24, 2008

(87) PCT Pub. No.: WO2007/127124

PCT Pub. Date: Nov. 8, 2007

(65) Prior Publication Data

US 2009/0096233 A1 Apr. 16, 2009

Related U.S. Application Data

(60) Provisional application No. 60/795,001, filed on Apr. 25, 2006.

(51) Int. Cl.
*A62C 33/04* (2006.01)
*A45F 5/00* (2006.01)

(52) U.S. Cl. ..... 294/143; 294/159

(58) Field of Classification Search ..... 294/143, 294/15, 163, 16, 137, 159, 161, 165, 169, 294/157, 25, 167; 16/422, 430; 248/68.1, 248/65, 75; 211/87.01

See application file for complete search history.

(56) References Cited

U.S. PATENT DOCUMENTS

| | | | | | |
|---|---|---|---|---|---|
| 877,012 | A | | 1/1908 | Sullivan | |
| 2,404,531 | A | * | 7/1946 | Robertson | 248/68.1 |
| 3,526,934 | A | * | 9/1970 | Owen, Sr. | 248/68.1 |
| 3,892,343 | A | | 7/1975 | Warner | |
| 4,030,540 | A | * | 6/1977 | Roma | 165/172 |
| 4,799,641 | A | * | 1/1989 | Koreski | 248/68.1 |
| 4,890,731 | A | | 1/1990 | Mroz | |
| 4,905,940 | A | * | 3/1990 | Luka | 16/2.1 |
| 5,060,810 | A | * | 10/1991 | Jones | 248/68.1 |
| D402,468 | S | * | 12/1998 | Killins | D3/315 |
| 6,032,999 | A | * | 3/2000 | York et al. | 294/143 |
| 6,726,166 | B2 | * | 4/2004 | Goodman | 248/58 |
| 6,986,538 | B1 | | 1/2006 | Ecker | |

* cited by examiner

*Primary Examiner* — Paul T Chin

(74) *Attorney, Agent, or Firm* — Carter, DeLuca, Farrell & Schmidt, LLP

(57) ABSTRACT

Disclosed is a device for carrying a hose or other tubular member. The device includes a first base member releasably connected to a second base member. The first and second base members operate to form a plurality of openings sized to receive a length of hose or other tubular member. The plurality of openings may be configured to permit charging of the hose without removing the hose from therein. The device may include a locking mechanism for selectively securing the first base member to the second base member. The locking mechanism may define a handle for supporting the device. The locking mechanism may further include a handle release for selectively unlocking the locking mechanism.

5 Claims, 37 Drawing Sheets

33E
454
455

33D
455
454

33C

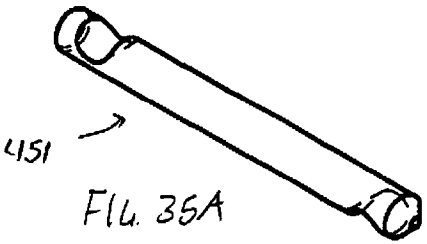
FIG. 35A
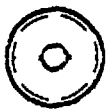
FIG. 35E
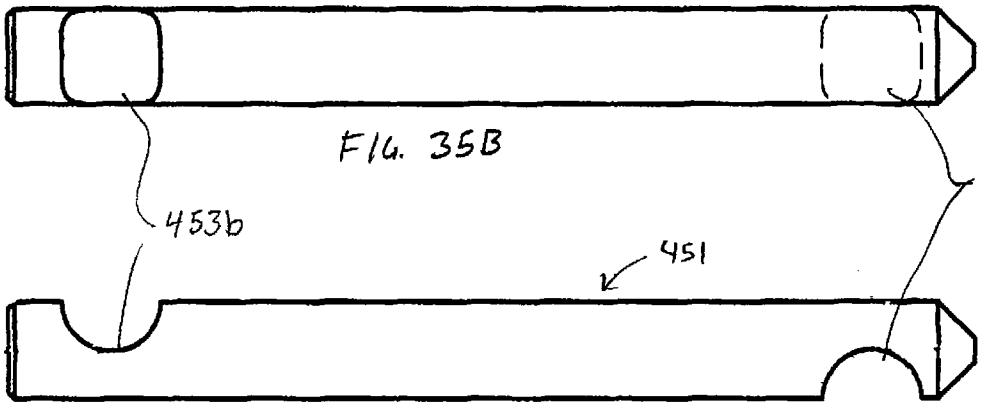
FIG. 35B
FIG. 35C
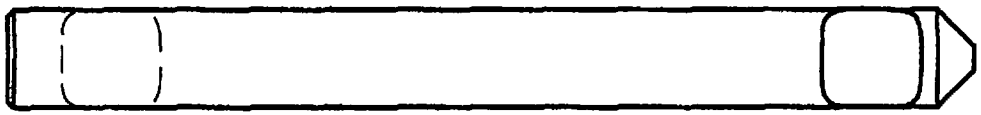
FIG. 35D

RACK FOR CARRYING A HOSE

CROSS-REFERENCE TO RELATED APPLICATION

This application is a U.S. National Stage claiming priority under 35 U.S.C. §371, to International Application No. PCT/US2007/009528, filed on Apr. 19, 2007, which claims the benefit of and priority to U.S. Provisional Application Ser. No. 60/795,001, filed on Apr. 25, 2006, the entire contents of which are each hereby incorporated by reference.

BACKGROUND

1. Technical Field

The present disclosure relates generally to devices for supporting a hose or the like, and more particularly, to a device capable of supporting a charged or uncharged fire hose, or the like.

2. Background of Related Art

Fire hoses are important tools used by fire fighters when extinguishing fires. Fires are rarely, if ever, conveniently located near a ready supply of water. Water may be supplied by a nearby hydrant or may be transported to the fire by a tanker truck. In either event, one or more fire hoses may be required to convey the water from its source to the fire. Fire hoses vary in length and may be as long as 50-100 feet. Fire hoses generally consist of an inner rubber tube, a fabric outer sheath encasing and protecting the inner rubber tube and a set of threaded connectors for coupling lengths of fire hose together and/or for attaching a nozzle. The size and composition of fire hoses cause them to be quite heavy and awkward to support and carry.

Conventional methods for carrying a fire hose require the hose to be empty while the fire hose is being stored or supported. Generally, a stored or carried fire hose is wound tightly or folded onto itself. The resulting compacted fire hose saves space and makes the long lengths of fire hose more manageable. Typically, the fire hose cannot be charged until the fire hose has been removed from the carrying device. When a fire hose is charged, or filled with water, the relatively flat fire hose, when uncharged, expands, causing the fire hose to stiffen and straighten out. Unfortunately, with conventional carrying methods, the wound or folded fire hoses must be removed from their support and/or unwound before the fire hose may be charged. Therefore, it would be beneficial to have a device or rack for carrying a fire hose that permits the filling of the fire hose without removing the fire hose from the carrying device.

SUMMARY

A rack for carrying a tubular body, preferably a fire hose, is disclosed. The rack includes a first base member and a second base member. The second base member may be securely attached to the first base. The first and second base members cooperate to form a plurality of recesses for receiving a hose when the two base members are attached one another. The rack may further include a locking mechanism for selectively securing the first base member with respect to the second base member. The locking mechanism may include a handle.

In an alternate embodiment the first and second base members may form recesses therebetween for receiving at least one biscuit. The at least one biscuit may prevent lateral separation of the first and second body members relative to one another.

The first and second base members may be hingedly secured to one another. One of the first or second base members may include a tongue configured to be lockingly received with a groove formed in the other of the first or second base members.

The handle of the carrying rack may be configured to be rotatably received by a locking pin. The locking pin may include a notch for selectively engaging the handle.

In another embodiment, a carrying rack for supporting a charged fire hose is disclosed. The rack includes a first body member, a second body member, a hinge connecting the first body member to the second body member, a locking mechanism for selectively locking the first body member to the second body member. The first and second body members define recesses configured for receiving a charged fire hose. The locking mechanism may include a handle for supporting the carrying rack. The hinge may be a living hinge. The first and second body member are injection molded.

Further disclosed is method of supporting a hose. The method includes the steps of providing a carrying rack having a first base member, a second base member securely attachable to the first base member, wherein the first and second base members cooperate to form a plurality of recesses for receiving a hose when the first and second base members are attached one another; and a locking mechanism for selectively securing the first base member with respect to the second base member; placing a hose within the recesses formed within the first base member; and locking the second base member to the first base member such that the hose is retained therein.

The locking mechanism of the carrying rack may form a handle. The method of supporting a hose may further include the step of supporting the carrying rack by the handle.

BRIEF DESCRIPTION OF THE DRAWINGS

The foregoing summary, as well as the following detailed description will be better understood when read in conjunction with the appended figures. For the purpose of illustrating the present disclosure, a preferred embodiment and alternate embodiments are shown. It is understood, however, that the present disclosure is not limited to the precise arrangement and instrumentalities shown.

FIGS. 35A-35E are perspective (FIG. 35A), top (FIG. 35B), side (FIG. 35C), bottom (FIG. 35D) and end (FIG. 35E) views of a lock and release pin of the carrying rack of FIGS. 31A-31C;

DETAILED DESCRIPTION OF THE DRAWINGS

Figure 1:
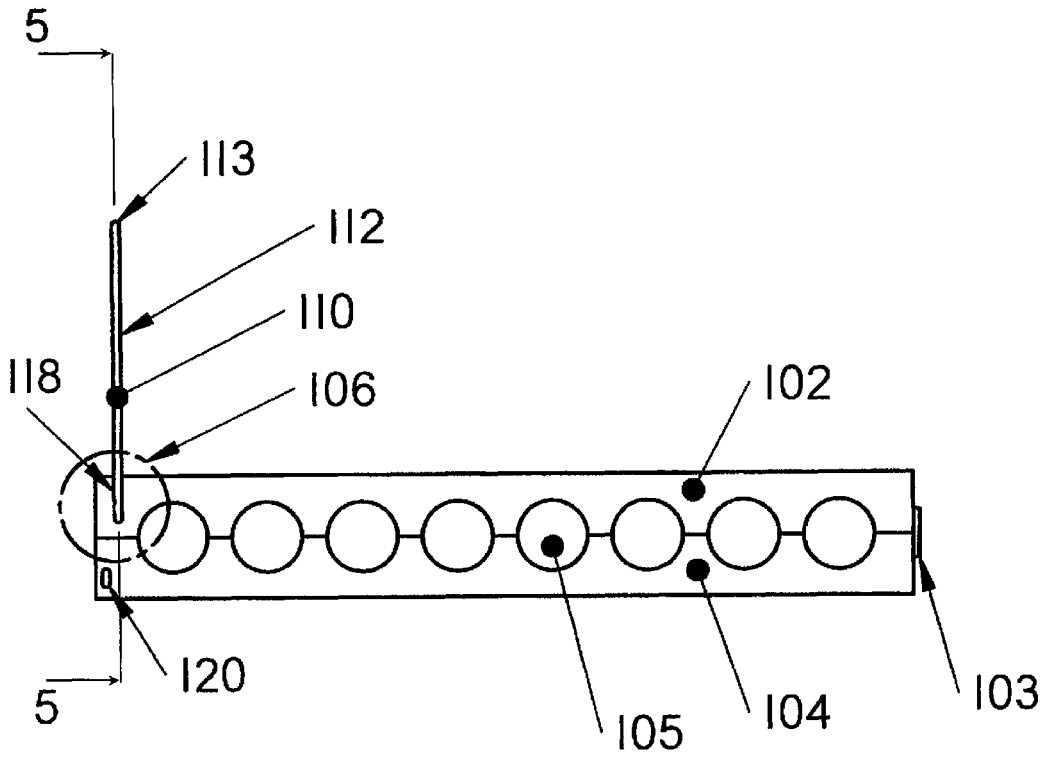
FIG. 1 is a right side view of a carrying rack constructed in accordance with an embodiment of the present disclosure.
Figure 2:
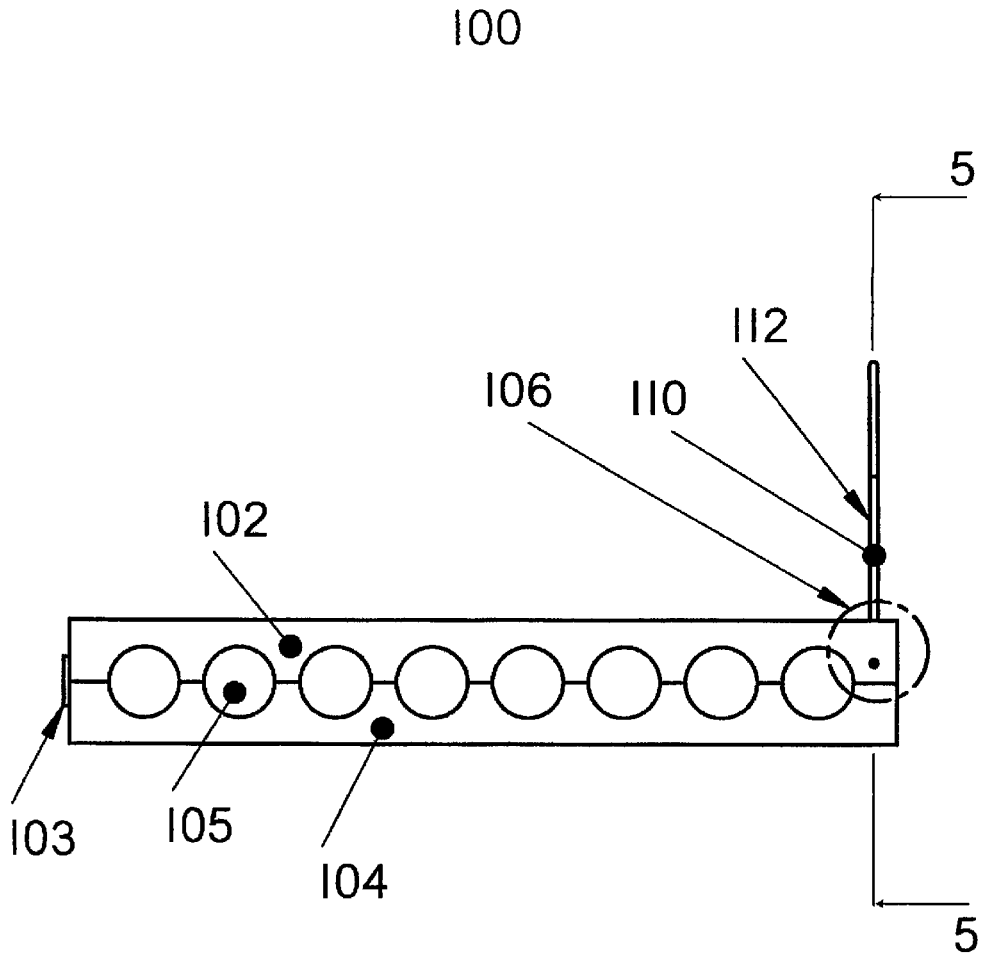
FIG. 2 is a left side view of the carrying rack of FIG. 1.
Figure 3:
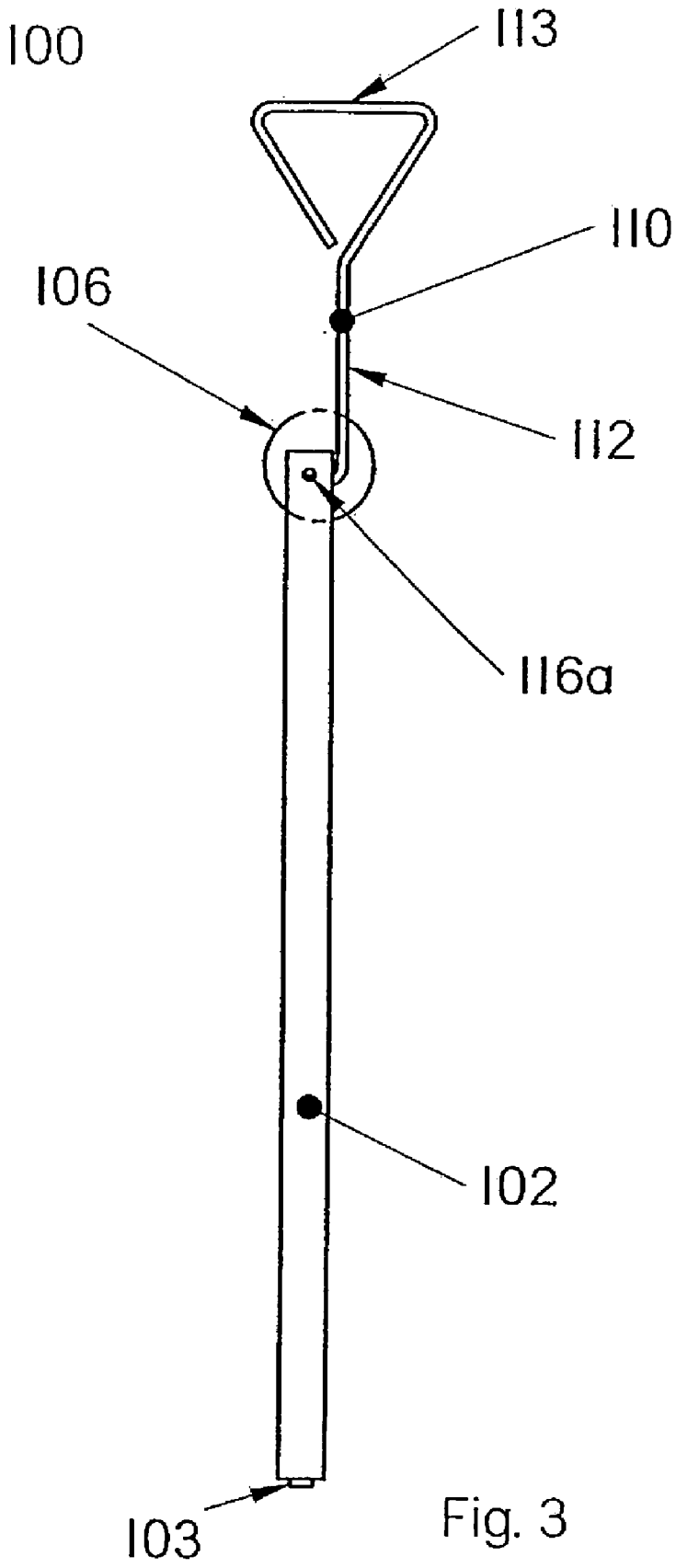
FIG. 3 is a top view of the carrying rack of FIGS. 1 and 2.
Figure 4:
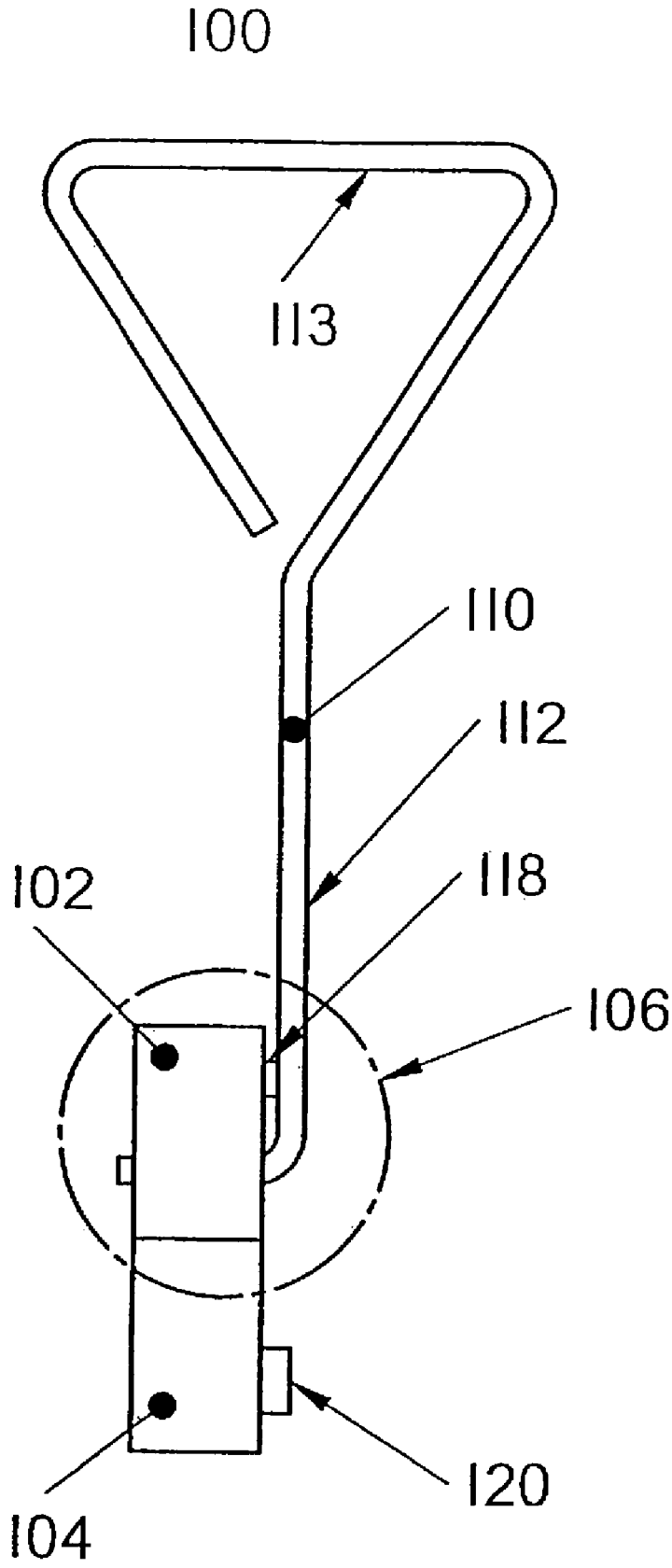
FIG. 4 is a front view of the carrying rack of FIGS. 1-3.

Preferred embodiments of the carrying rack and methods in accordance with the present disclosure will now be described in detail with reference to the drawing figures wherein like reference numerals identify similar or identical structural elements.

Referring to FIGS. 1-4, an illustrative embodiment of the presently disclosed carrying rack is illustrated therein and generally designated as carrying rack 100. Carrying rack 100 includes a first base member 102, a second base member 104 hingedly attached to first base member 102, and a locking mechanism 106 for releasably securing first base member 102 with second base member 104.

As seen in FIGS. 1-4, first and second base members 102, 104 are configured to form a plurality of openings 105 when first base member 102 and second base member 104 are approximated toward one another. Openings 105 are sized and dimensioned to receive a charged or uncharged fire hose (not explicitly shown). Unlike a fire hose that is empty or uncharged, and therefore takes on a flattened cross-section, a charged fire hose is full of water and expands to its maximum diameter. Thus, openings 105 may appear larger than necessary when supporting an empty fire hose. Openings 105 may have rounded or radiused edges to reduce friction between the outer surface of the fire hose and base members 102, 104. While openings 105 are shown as having a round profile, it is envisioned and within the scope of the present disclosure for openings 105 to have any suitable shaped profile, including and not limited to ovular, rectangular, triangular, etc.

While openings 105 formed in base members 102, 104 are dimensioned to receive a fire hose, it is envisioned that the invention of the present disclosure can be adapted to support and carry hoses of all diameters and thicknesses. It is further envisioned that the openings for receiving a fire hose may be formed entirely in either the first or second base members 102,104 as well as between the two members 102, 104 in any configuration. Carrying rack 100 may have any number of openings 105. The number of openings 105 formed by carrying rack 100 may correspond to the length of fire hose being supported.

Carrying rack 100 may be constructed from any number of rigid materials. Preferably, first and second base members 102, 104 are constructed of hard plastic or polymer, however, wood and metal (ie, stainless steel) carry racks are also envisioned.

First and second base members 102, 104 are hingedly attached to one another by hinge 103. Hinge 103 is positioned on corresponding adjacent ends of first and second base members 102, 104 and operates such that opposing adjacent ends of first and second base members 102, 104 may be articulatably separated. Hinge 103 may be constructed of metal, plastic or the like. Hinge 103 may be of any conventional configuration and may be attached to first and second base members 102, 104 by any suitable known means, including with mechanical fasteners, adhesives, welding and the like.

Figure 13:
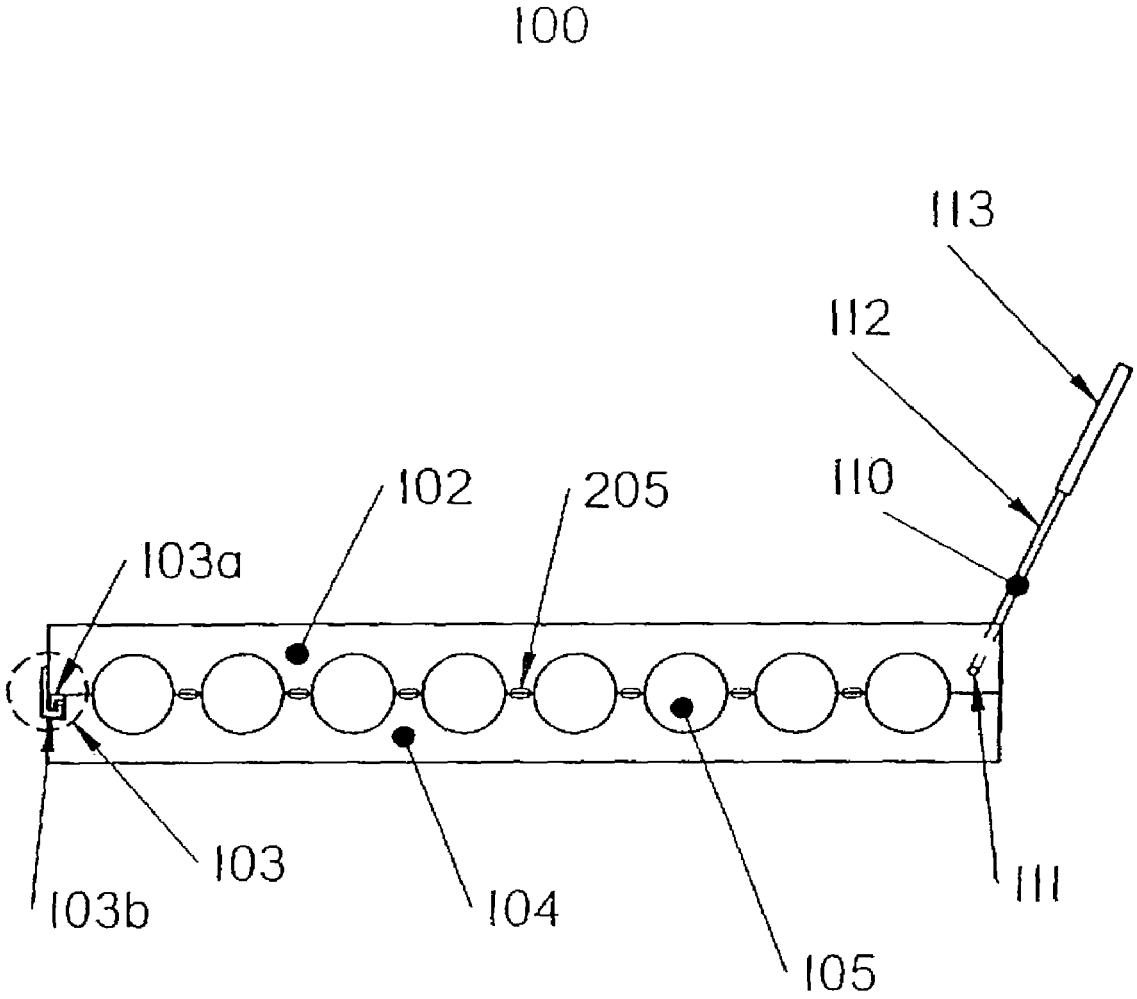
FIG. 13 is a side view of the carrying rack of FIGS. 1-4 illustrating an alternate embodiment in accordance with the present disclosure.
Figure 14:
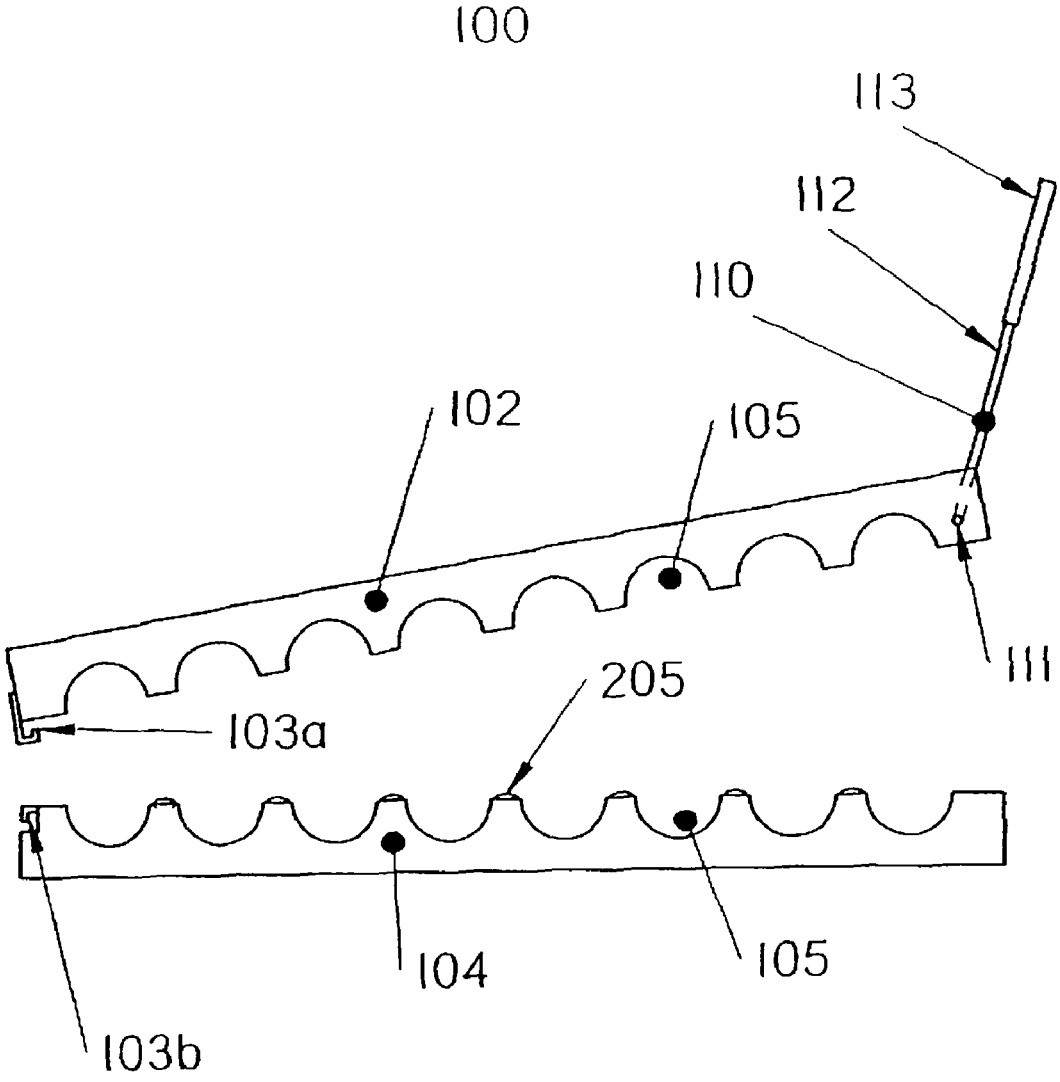
FIG. 14 is a side view of the carrying rack of FIG. 13 shown in an open and separated condition.

In an alternate embodiment of the present disclosure hinge 103 connecting the first and second base members may be a living hinge that is constructed as an integral part of the first and/or second base members 102,104. Hinge 103 may further include a pin or pins for securing the first base member 102 to the second base member 104. Hinge 103 may also be of a break-away, or readily separable, design whereby a supported fire hose may be more easily removed therefrom (see FIG. 13-14). As seen in FIGS. 13 and 14, break-away hinge 103 includes a first hinge member 103*a* securely mounted to first base member 102 and second hinge member 103*b* securely mounted to second base member 104. In an alternate embodiment, break-away hinge members 103*a*,103*b* may be integrally formed with first and second base members 102,104, respectively. First hinge member 103*a* is configured to releasably engage second hinge member 103*b*.

Figure 5:
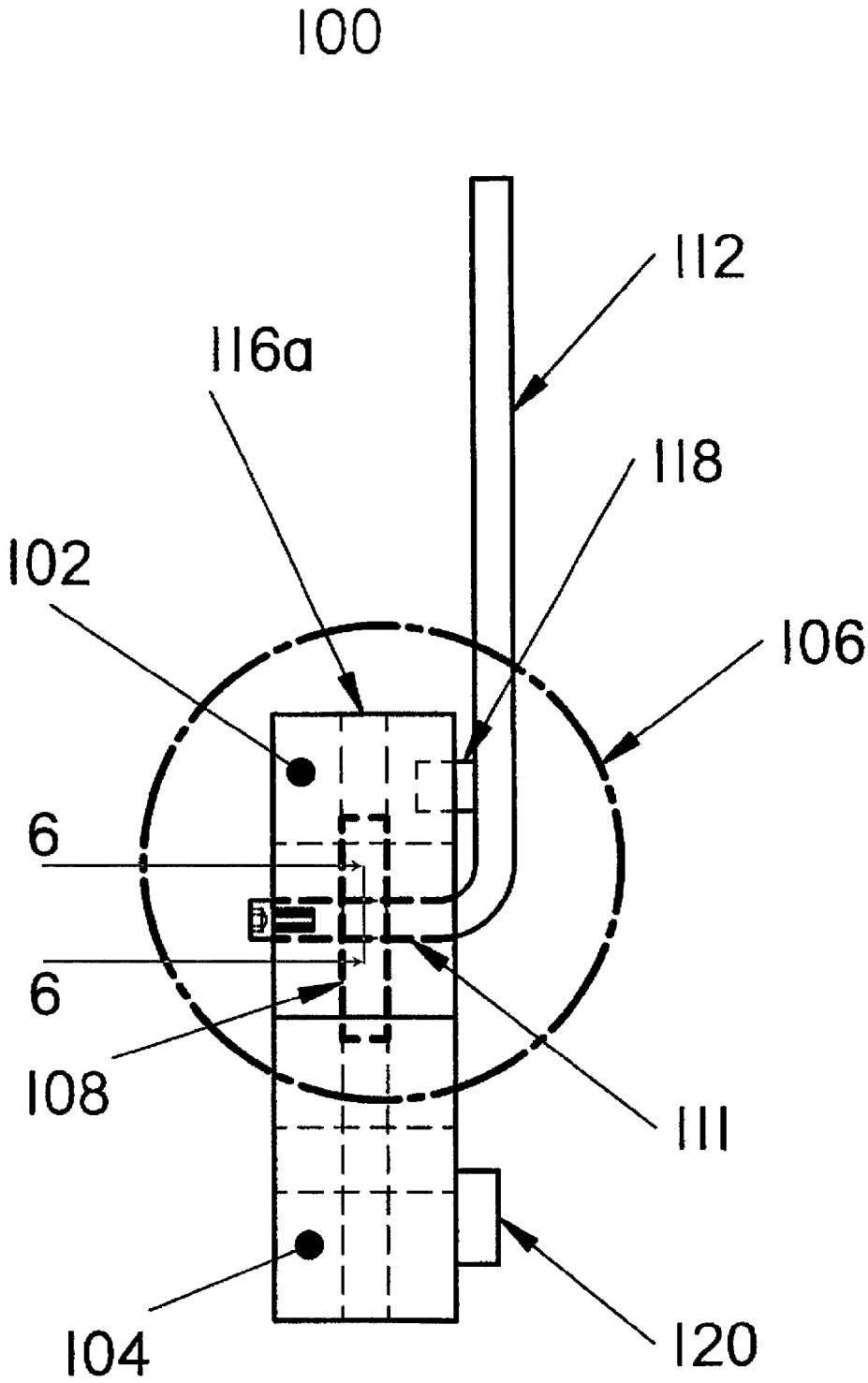
FIG. 5 is an enlarged cross-sectional view of the locking mechanism of the carrying rack of FIGS. 1-4, as taken along line 5-5 of FIGS. 1 and 2.
Figure 6:
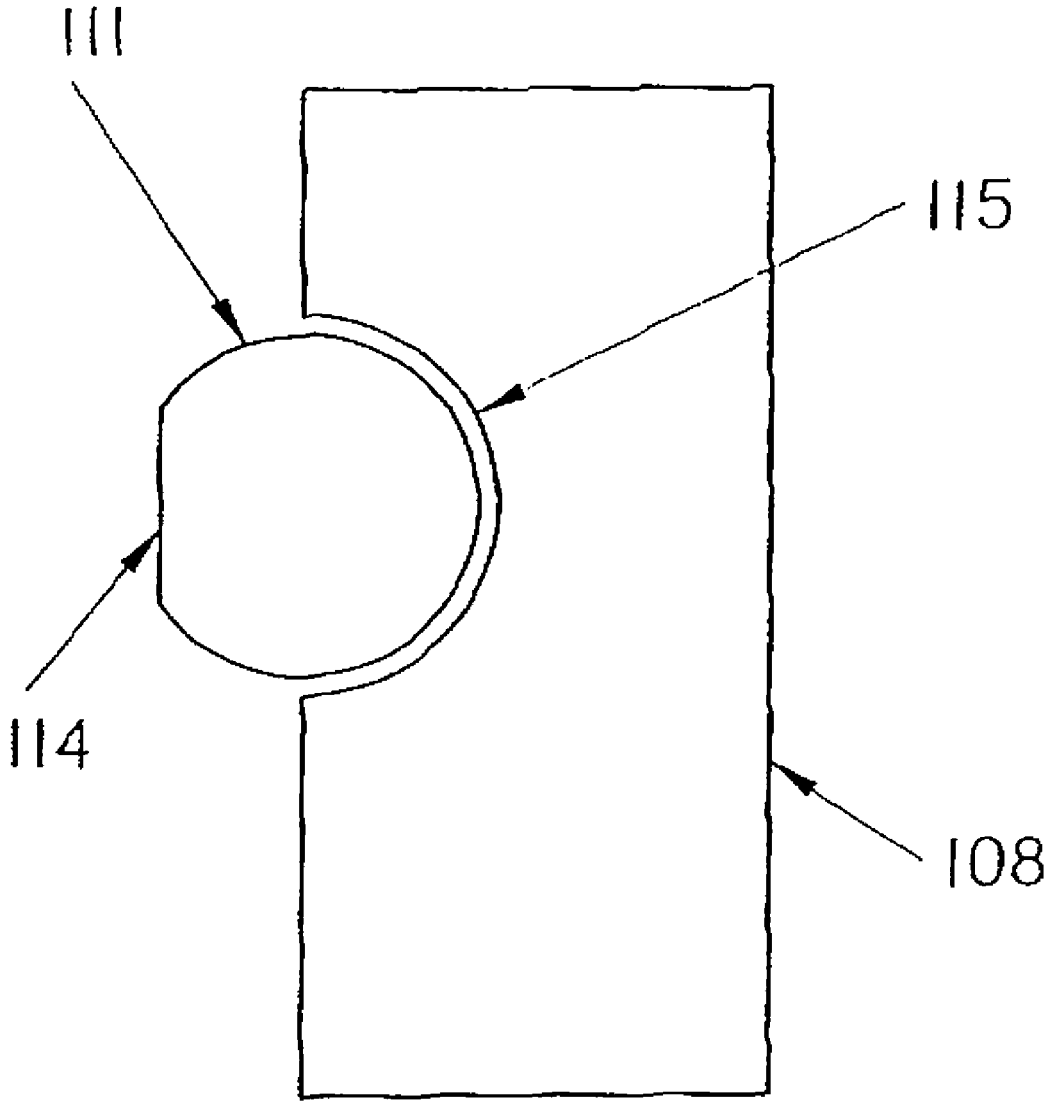
FIG. 6 is an enlarge cross-sectional view of the locking mechanism of FIG. 5 taken along line 6-6 of FIG. 5.

Carrying rack 100 includes locking mechanism 106 operably connected to first and second base members 102, 104 for releasably securing first and second base members 102, 104 to one another. As seen in FIGS. 5 and 6, locking mechanism 106 includes locking pin 108 and locking bar 110. Locking bar 110 forms an L-shaped member having a base 111 and an elongate body 112. Elongate body 112 terminates in handle 113 (See FIGS. 1-4). Handle 113 may be of any size and configuration, and is adaptable to suit various preferences and applications.

Base 111 of locking bar 110 is pivotally mounted to first base member 102 of carrying rack 100. Base 111 forms a cylindrical shaft having a cut-out or notch 114 (see FIG. 6) located near the mid-point of base 111. First base member 102 includes a recess 116 perpendicularly aligned with mounted base 111 of locking bar 110. Locking pin 108 is securely affixed to second base member 104 and is positioned to be received within recess 116 of first base member 102. Locking pin 108 includes a corresponding cut-out or notch 115 (see FIG. 6) configured for cooperative engagement with notch 114 of base 111. Recess 116 may extend completely through first base member 102 to form clean out hole 116*a*. Clean out hole 116*a* may be used to remove any debris that may accumulate in recess 116 preventing locking pin 108 from being completely received within recess 116.

As seen in FIG. 6, when notch 114 of base 111 is oriented away from cut-out 115 of locking pin 108, locking pin 108 is secured in position and prevented from moving, thereby maintaining first and second base members 103, 104 clamped together. As is understood, in operation, when notch 114 of base 111 is oriented toward cut-out 115 of locking pin 108, locking pin 108 is free to be pulled out of recess 116 of first base member 102 and thus allow first and second base members 102, 104 to be separated. In operation, rotation of base 111 about axis "Y", as a result of the movement of elongate body 112, results in the alignment and un-alignment of notch 114 of base 111 with cut-out 115 of locking pin 108.

Locking mechanism 106 further includes a handle release 118 and a handle stop 120. Handle release 118 is positioned on and extends from first base member 102. Handle release 118 is configured to retain handle 113 in a predetermined alignment. Handle release 118 further prevents the premature or unintentional unlocking of locking mechanism 106, and thus the separation of first and second base members 102, 104. Handle stop 120 is positioned on and extends from second base member 104 and is configured to prevent 360° rotation of handle 113 and/or elongate body 112. Handle release 118 and handle stop 120 may be constructed of metal, plastic, or the like.

Figure 7:
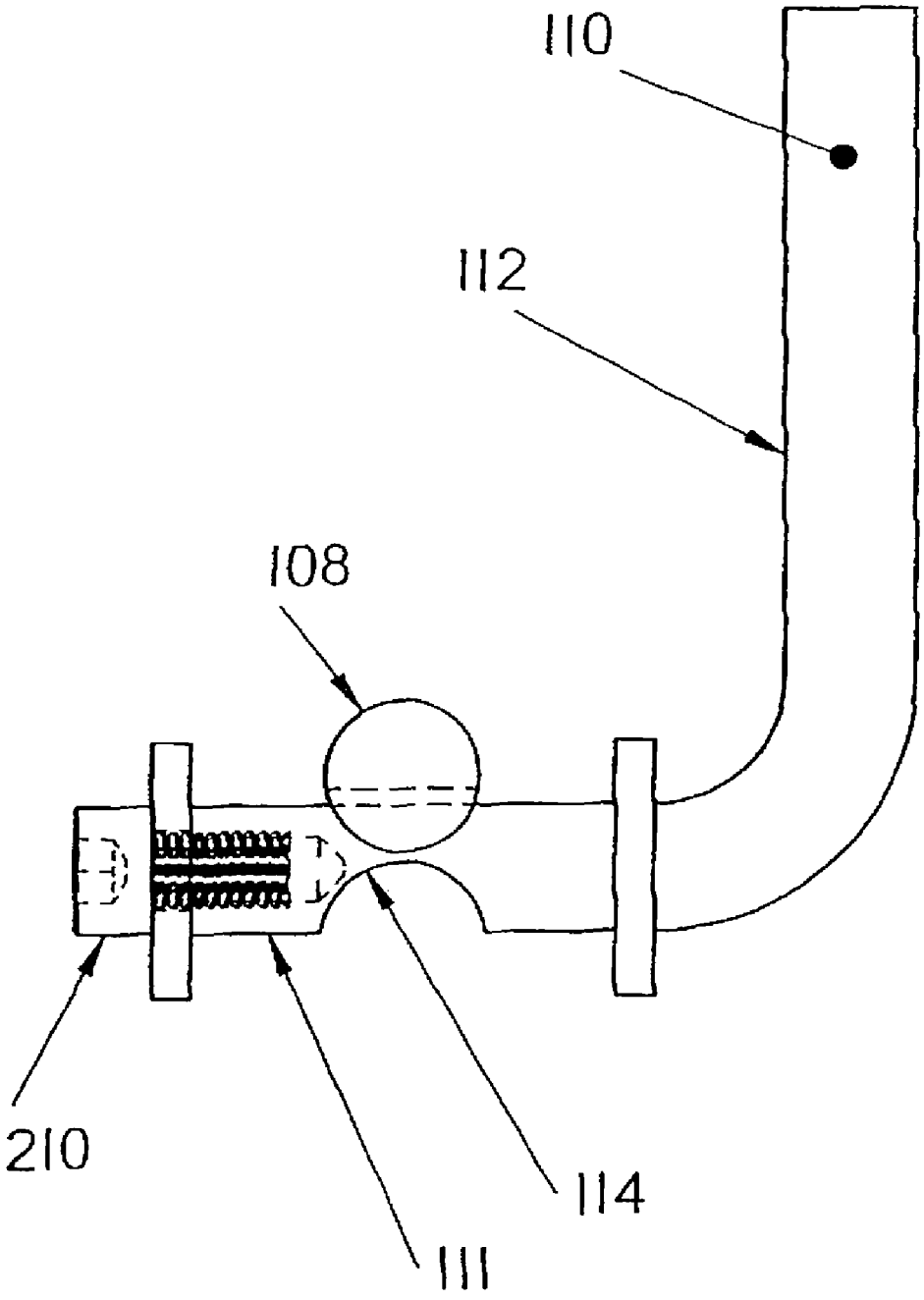
FIG. 7 is a cross-sectional view of the locking mechanism of FIGS. 5 and 6 taken along line 5-5 of FIGS. 1 and 2.
Figure 8:
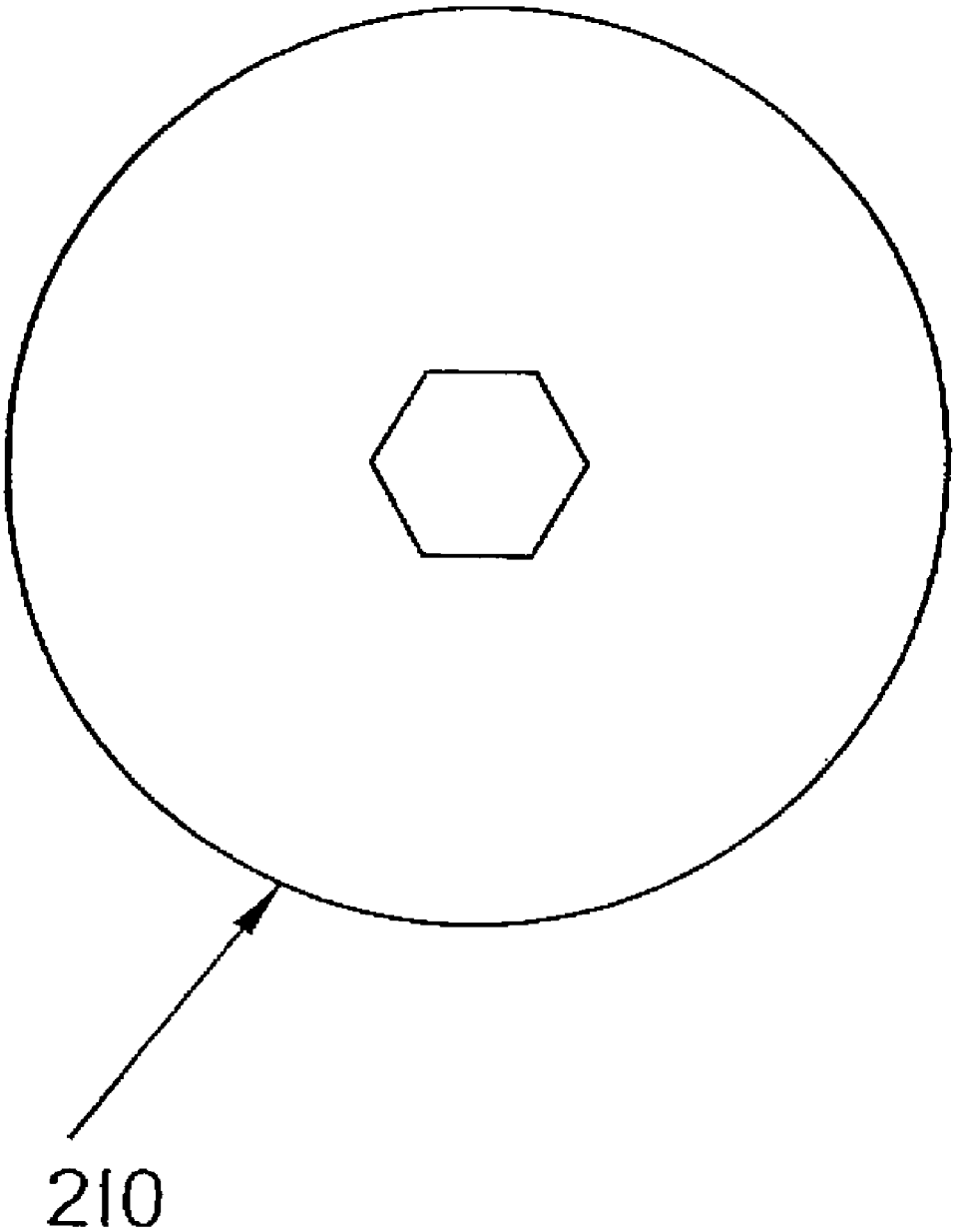
FIG. 8 is an end view of the locking mechanism of FIG. 7.

By way of example only, base 111 of locking bar 110 may have a threaded end (FIG. 7) for receiving a fastener for securing locking bar 110 to first base member 102. In this alternate embodiment, locking bar 110 may be secured to first base member 102 with a screw 210 having an allen key configuration (FIG. 8). All other fastening means have been contemplated by this disclosure for pivotally securing locking bar 110 to first base member 102. It is further envisioned that base 111 may be configured such that first base member 102 may be molded or formed about base 111, whereby base 110 will become an integral part of first base member 102. It is further envisioned that locking pin 108 may be integrally formed with second base member 104.

Figure 9:
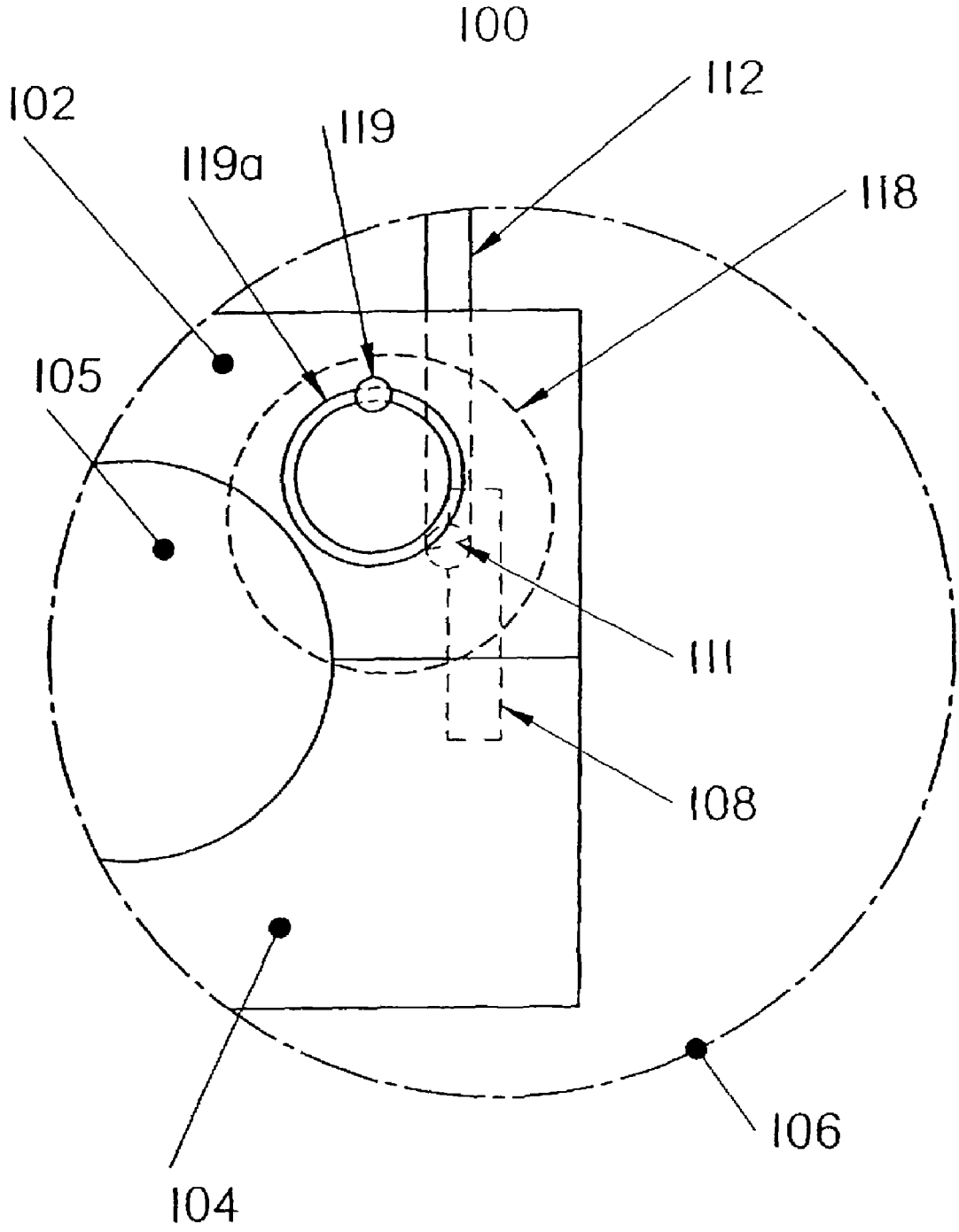
FIG. 9 is a left side view of an alternate embodiment of a locking mechanism for the carrying rack of FIGS. 1-4.
Figure 10:
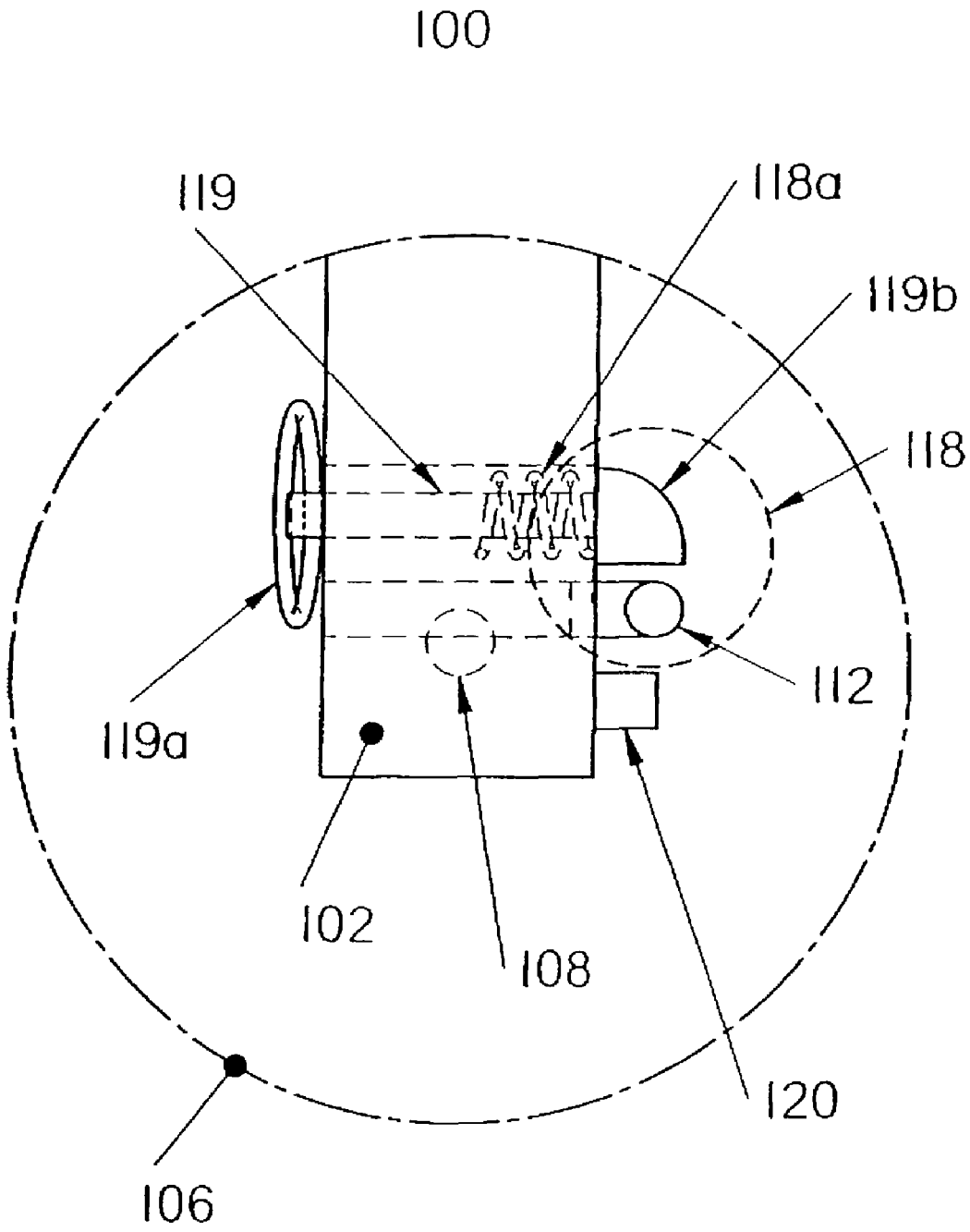
FIG. 10 is a top view of the locking mechanism of FIG. 9.
Figure 11:
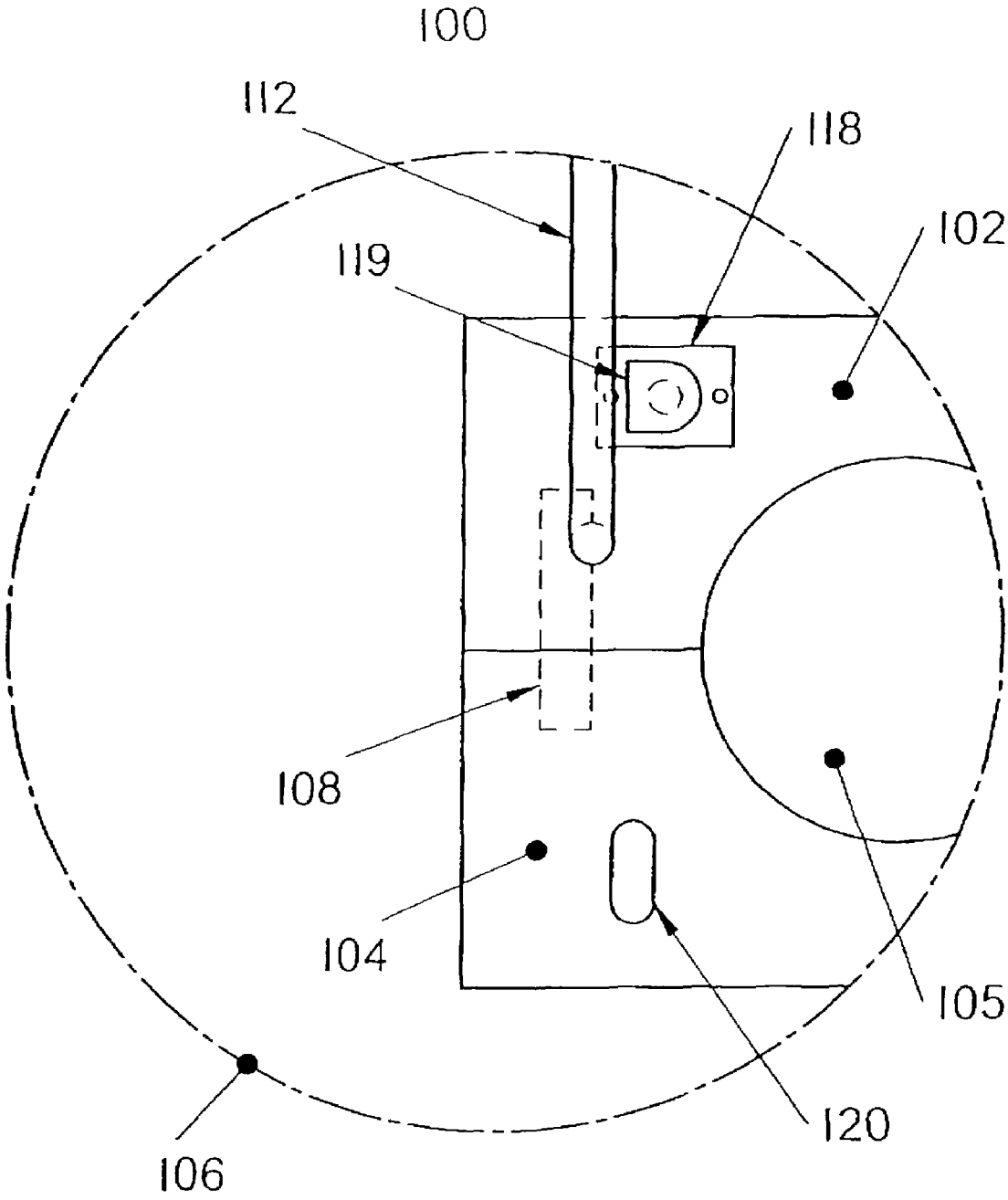
FIG. 11 is a right side view of the locking mechanism of FIGS. 10 and 11.

Referring now to FIGS. 9-11, in an alternate embodiment, handle release 118 may include a release pin 119 biasedly attached to first base member 102 by spring 118*a*. Release pin 119 includes ring or other grasping member 119*a* for securely grasping release pin 119. Release pin 119 is configured such that in a normal, unretracted position elongated body 112 is restricted from passing release pin 119, and thereby unlocking first base member 102 from second base member 104. When ring 119*a* is pulled against the bias spring 118*a*, release pin 119 is retracted and, elongated body 112 is permitted to pass. Once ring 119*a* is released, spring 118*a* returns release pin 119 to an unretracted position.

Release pin 119 is further configured such that elongated body 112 is permitted to pass beyond release pin 119 without retracting release pin 119 using ring 119*a*. In particular, a distal surface 119*b* of release pin 119 is angled such that as elongate body 112 is moved in a direction toward and beyond, angled distal surface 119*b*, elongate body 112 cams against angled distal surface 119*b* causing release pin 119 to retract against the bias of spring 118*c* and allow elongate body 112 to move beyond release pin 119 to a locked position.

Figure 12:
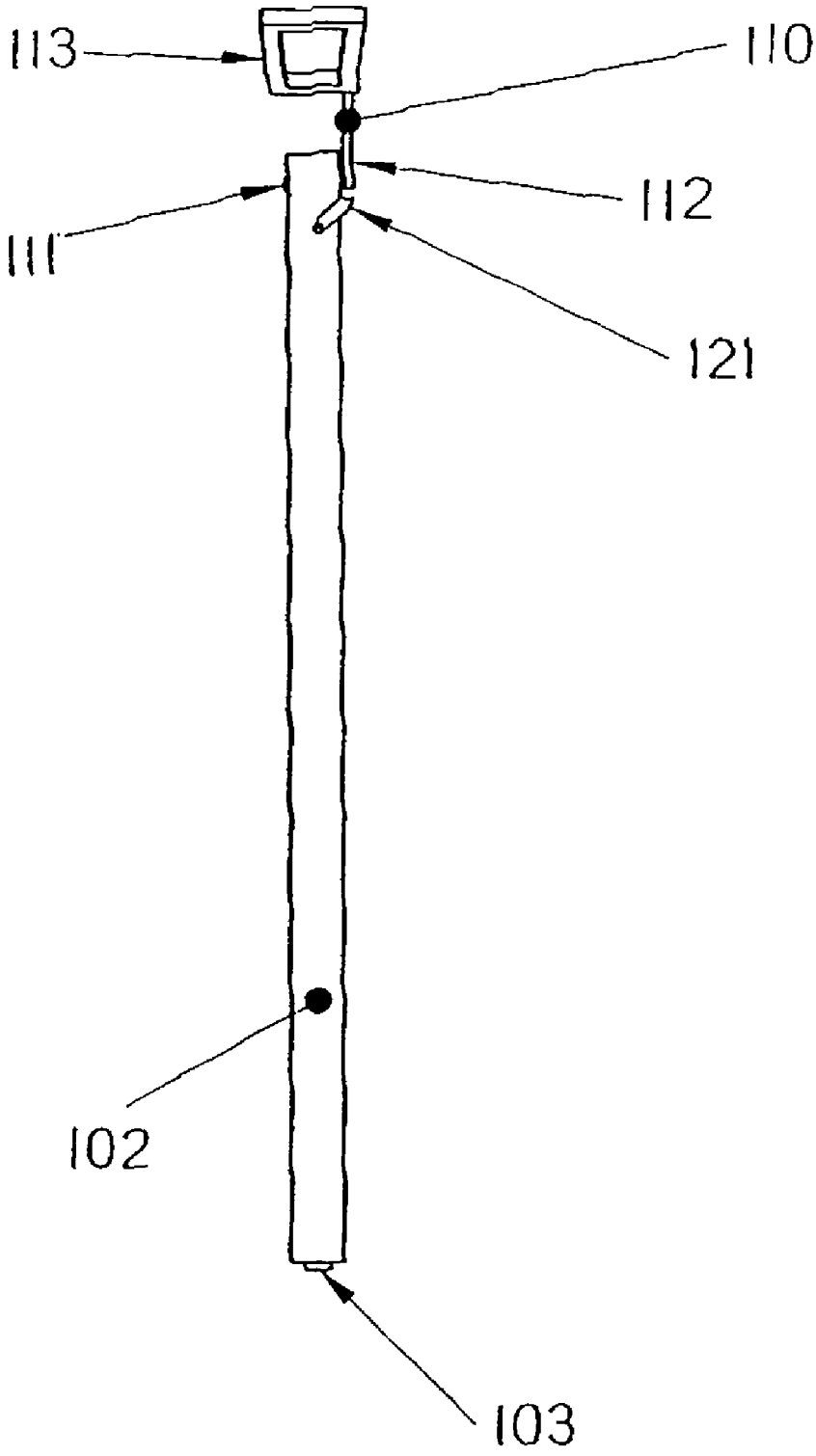
FIG. 12 is another alternate embodiment of a locking mechanism for the carrying rack of FIGS. 1-4.

Referring now to FIG. 12, in yet another embodiment of the present disclosure, handle release 118 is in the form of a moveable clip, tab or finger 121 selectively supported on first base member 102 and functions to prevent elongate member 112 from passing clip 121, and thereby unlocking first and second base members 102,104. Clip 121 may be integrally formed with first base member 102 or may be fixedly attached to the top surface of first base member 102. Similar to release pin 119, clip 121 is configured to be retracted or deflected, such that elongate member 112 is permitted to pass thereby. Clip 121 is further configured such that elongate member 112 is permitted to return past clip 121 without manually retracting clip 121.

Referring now to FIGS. 13 and 14, in an alternate embodiment of the present disclosure, first and second base members 102, 104 of carrying rack 100 may be configured to receive biscuits 205 between openings 105 formed in first and second base members 102, 104. First and second base members 102, 104 may be configured such that when biscuits 105 are positioned between openings 105, biscuits 205 prevent lateral movement or separation of first and/or second base members 102, 104 from one another.

Figure 15:
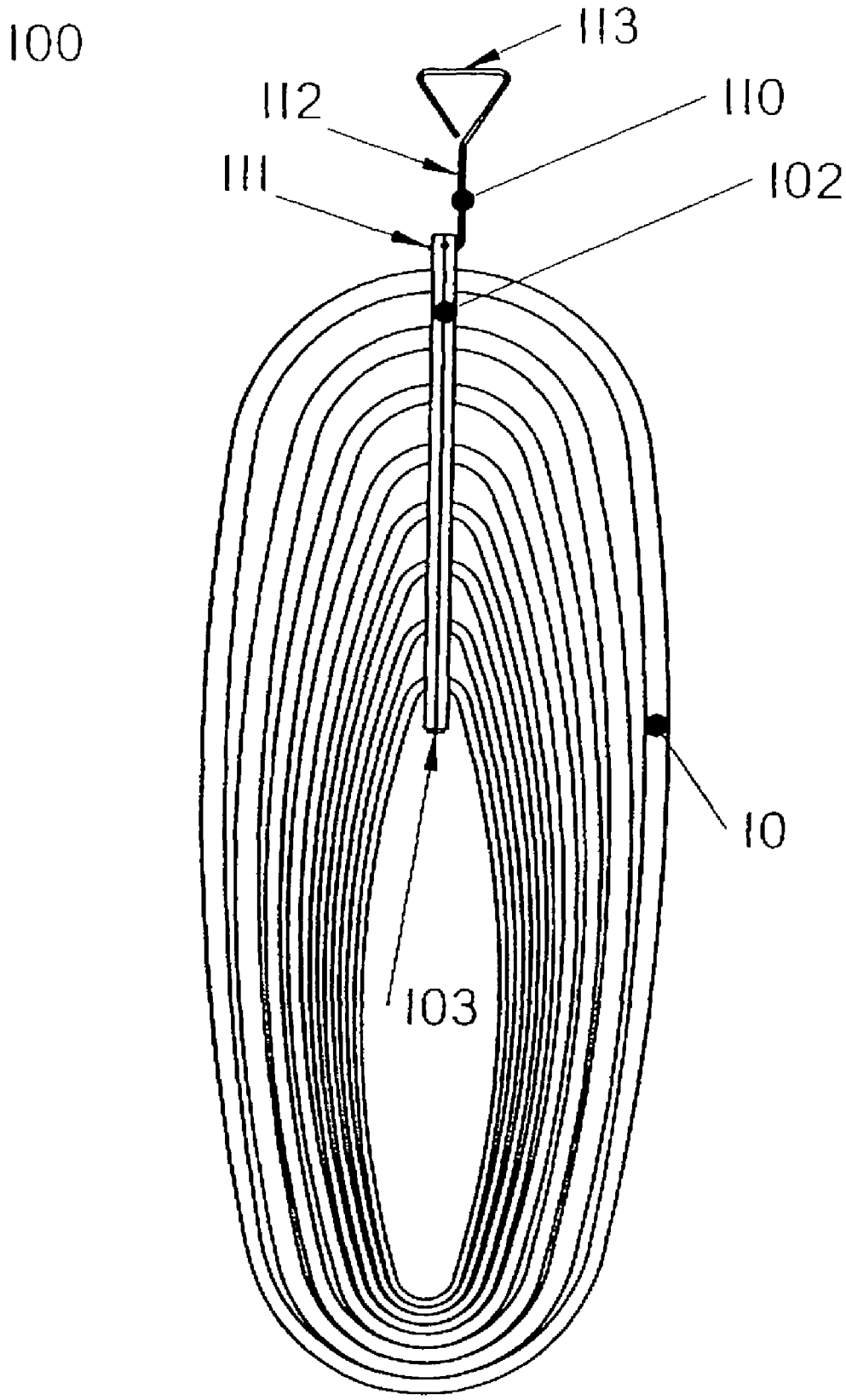
FIG. 15 is a plan view of the carrying rack of FIGS. 1-4 supporting an empty or uncharged fire hose.
Figure 16:
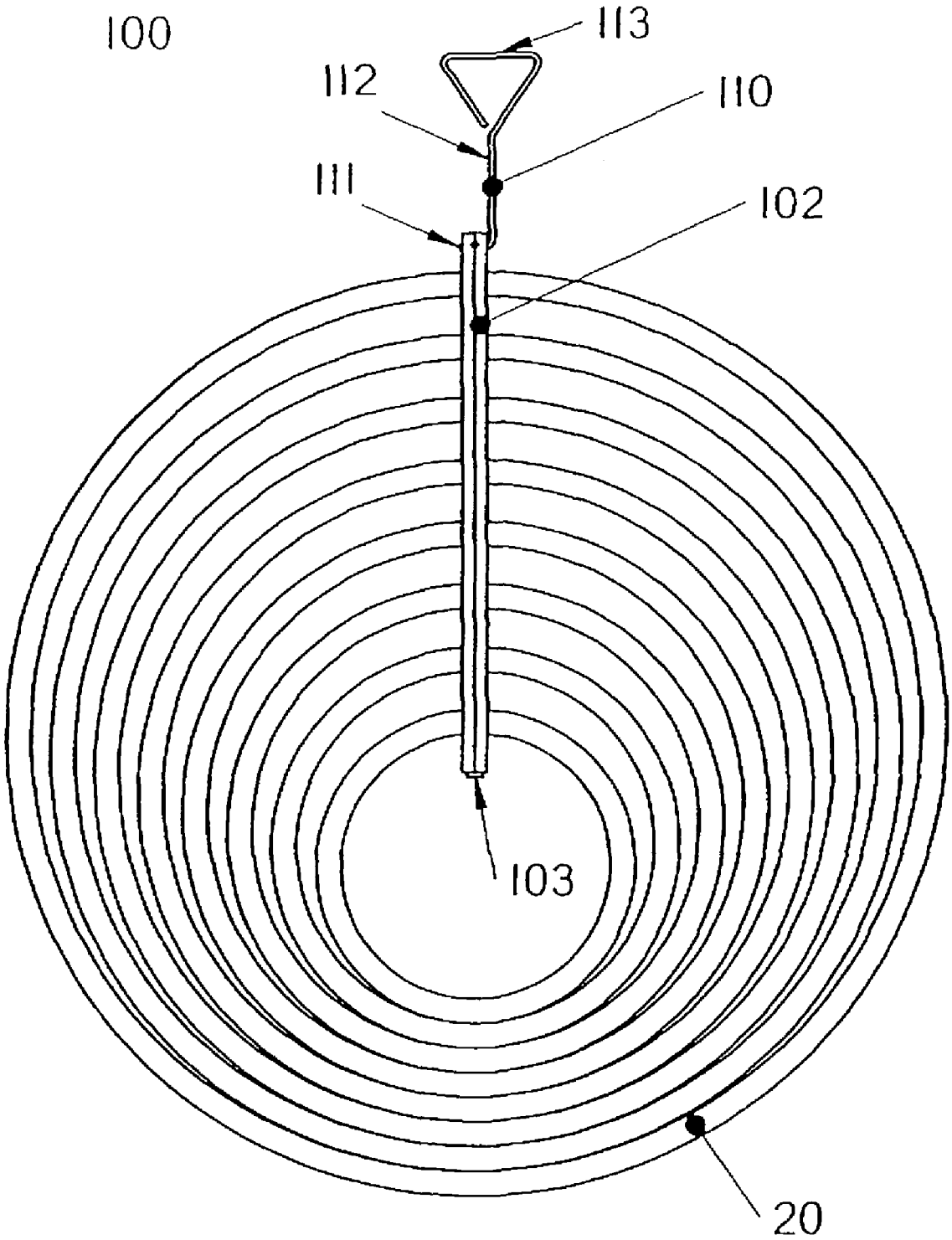
FIG. 16 is a plan view of the carrying rack of FIG. 9 shown supporting a full or charged fire hose.
Figure 17:
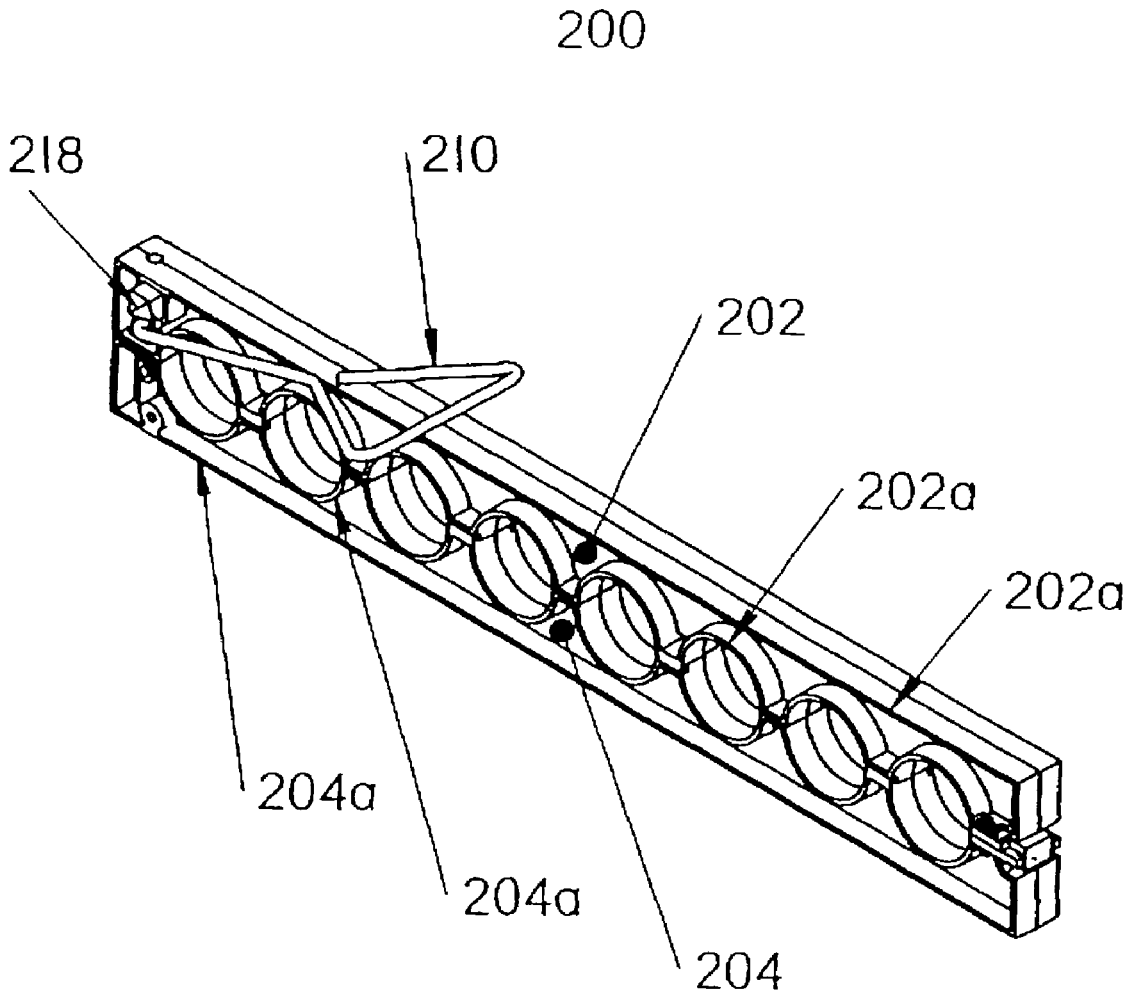
FIG. 17 is a perspective side view of another embodiment of a carrying rack in accordance with the present disclosure.
Figure 18:
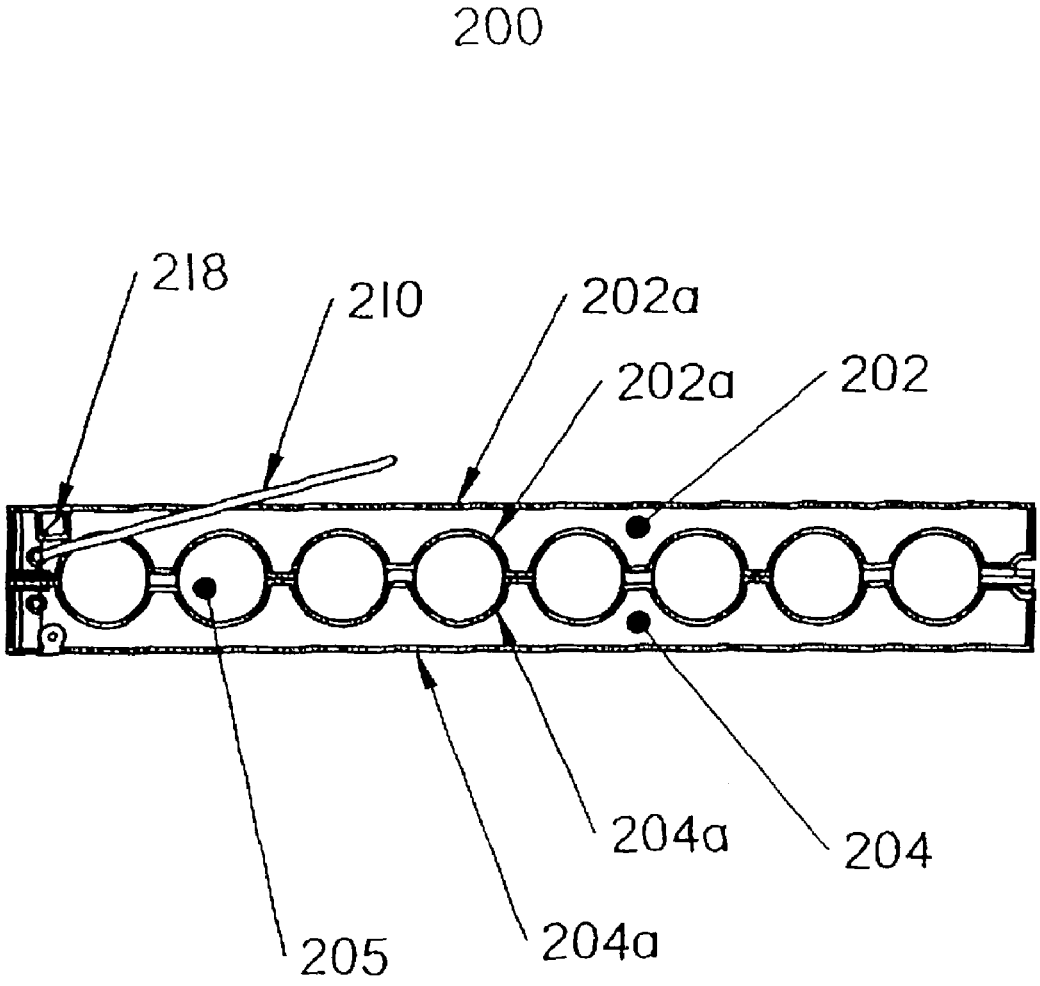
FIG. 18 is a side view of the carrying rack of FIG. 17.
Figure 19:
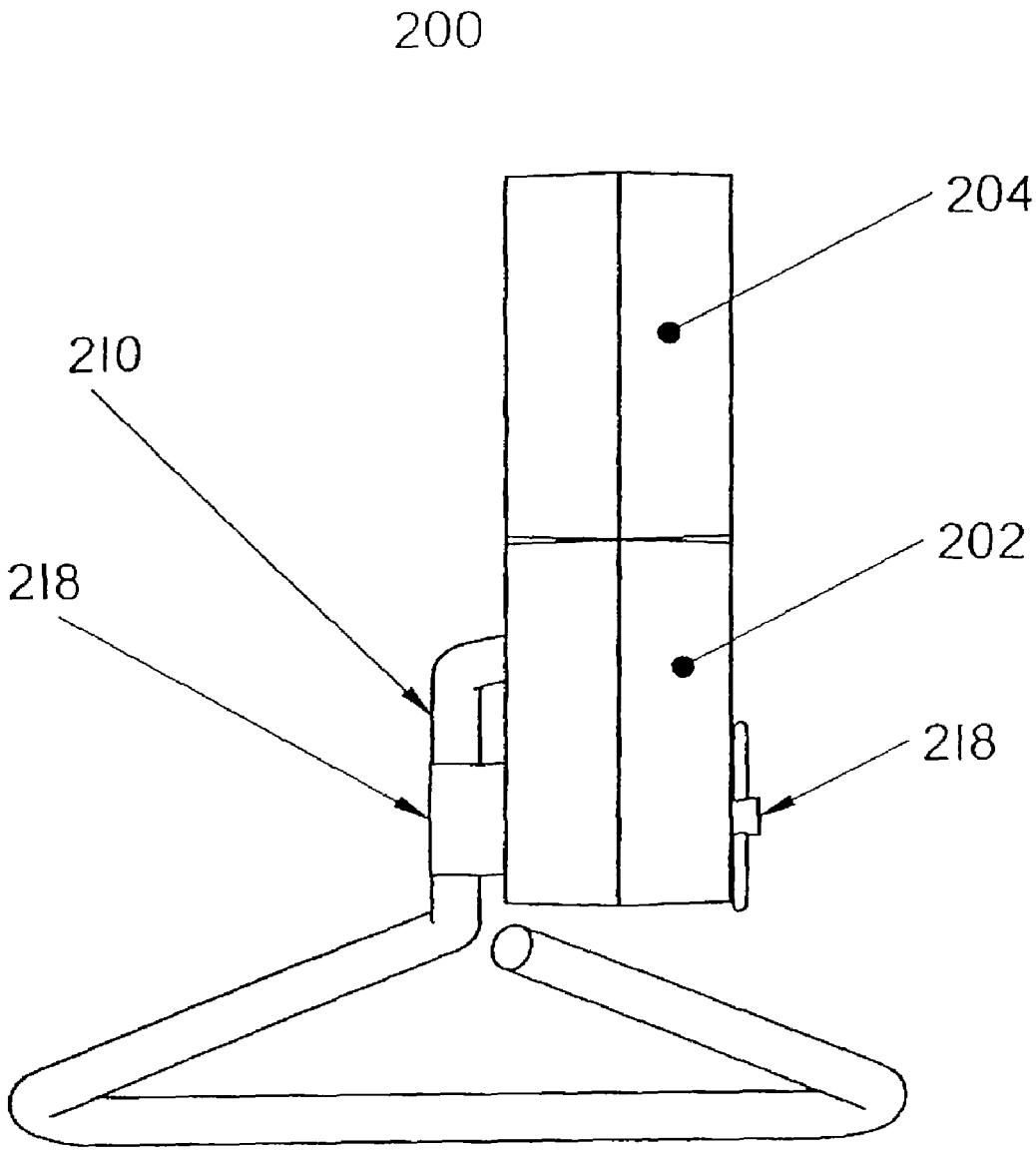
FIG. 19 is an end view of the carrying rack of FIGS. 17-18.
Figure 20:
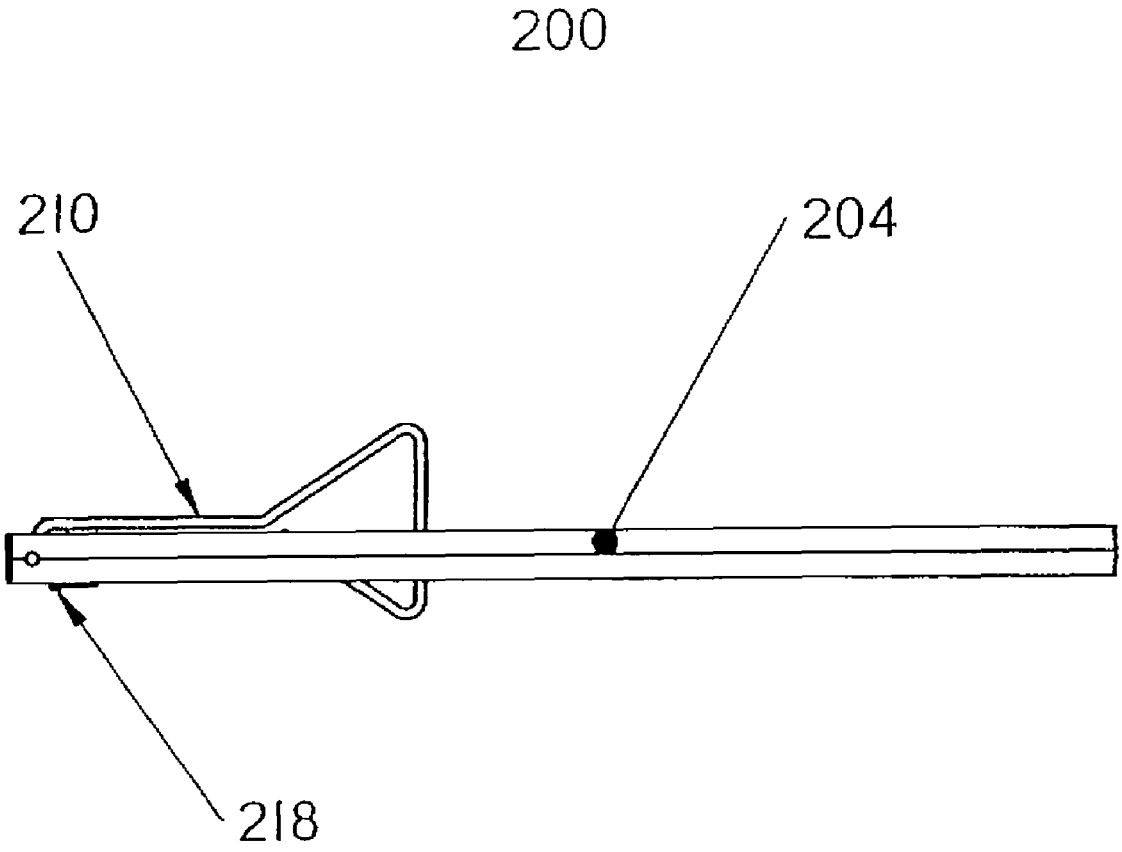
FIG. 20 is a bottom view of the carrying rack of FIGS. 17-19.
Figure 21:
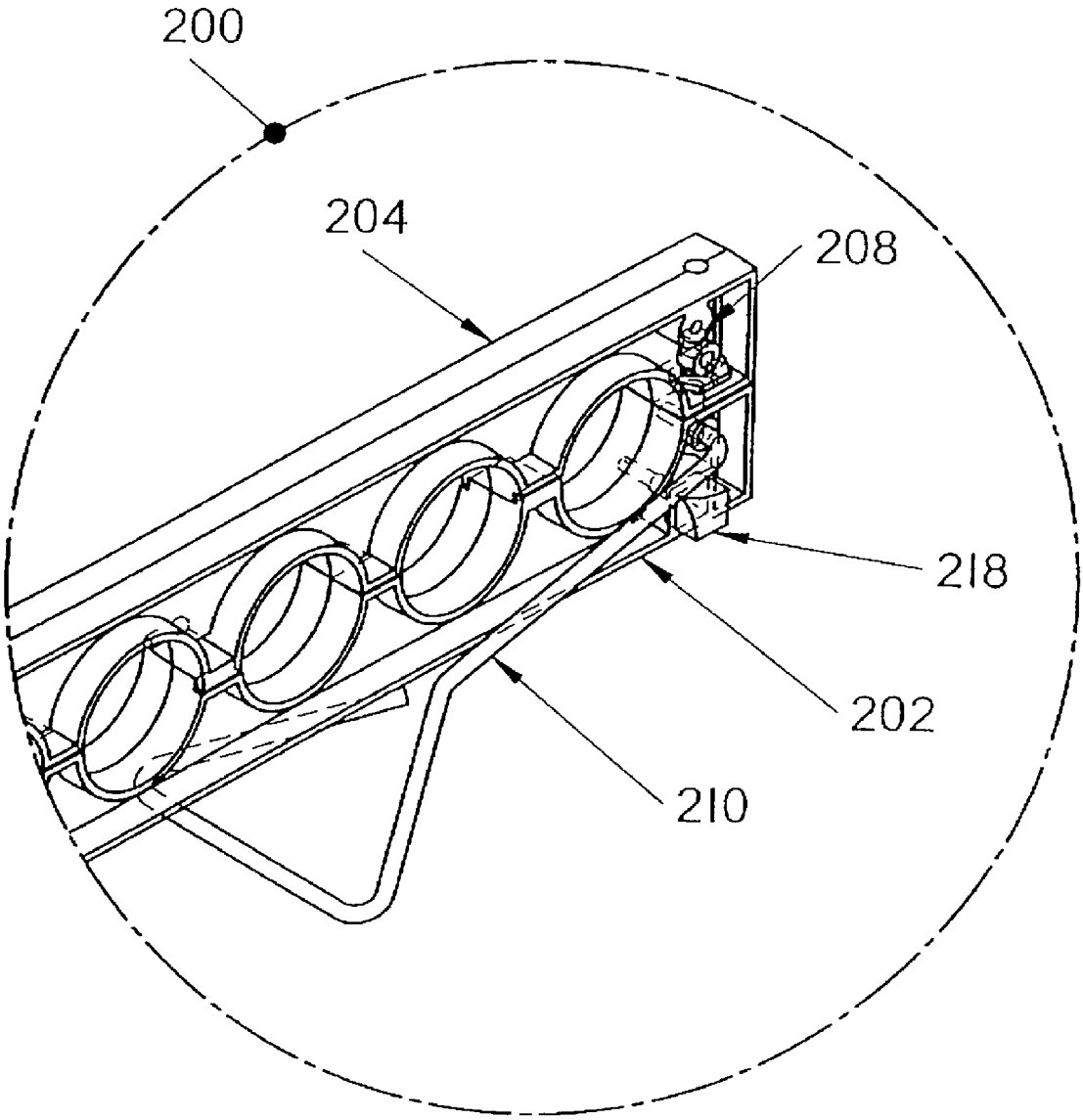
FIG. 21 is an enlarged perspective view of the locking end of the carrying rack of FIGS. 17-20.
Figure 22:
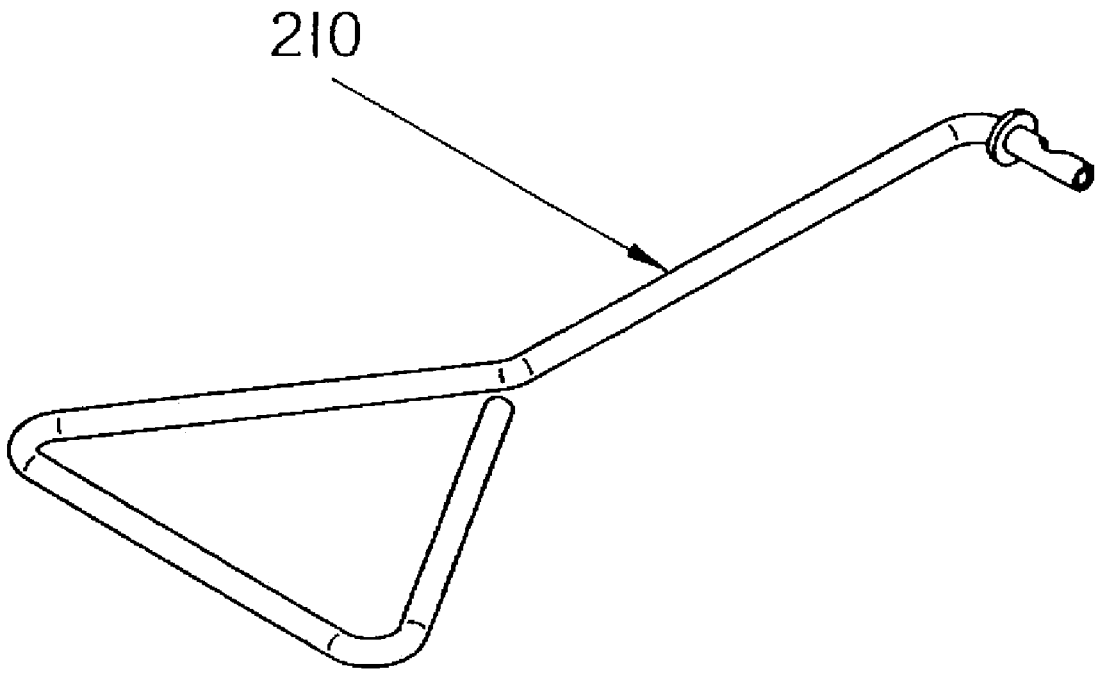
FIG. 22 is an enlarged perspective view of the handle or locking bar of the carrying rack of FIGS. 17-21.
Figure 23:
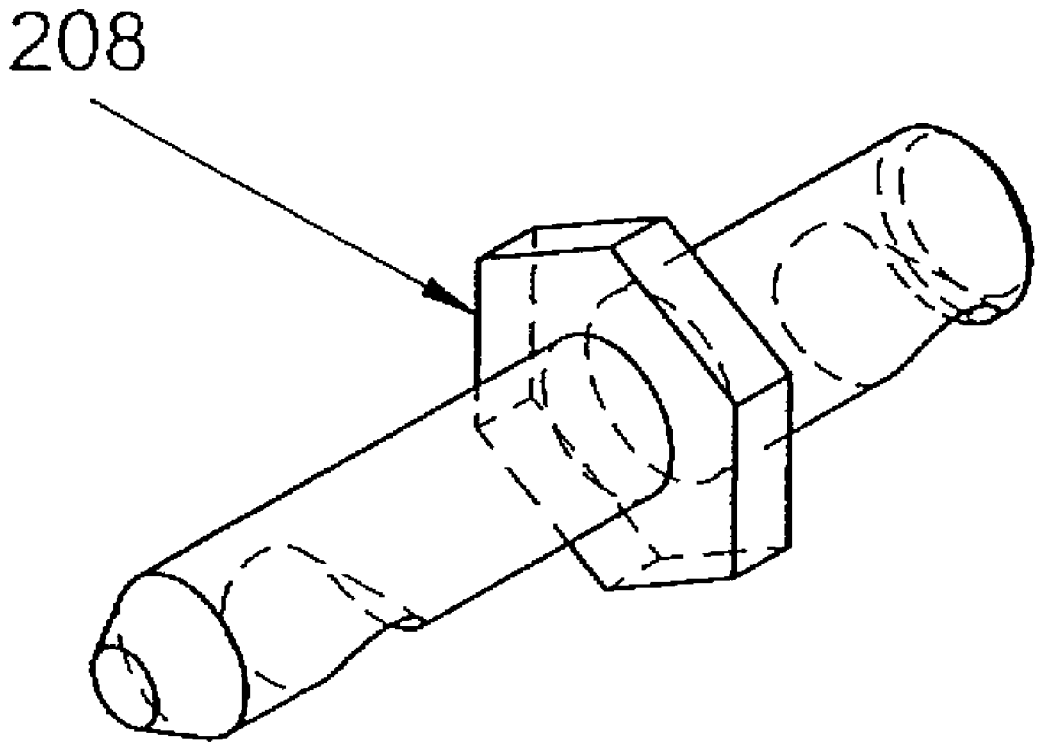
FIG. 23 is an enlarged perspective view of the locking pin of the carrying rack of FIGS. 17-21.
Figure 24:
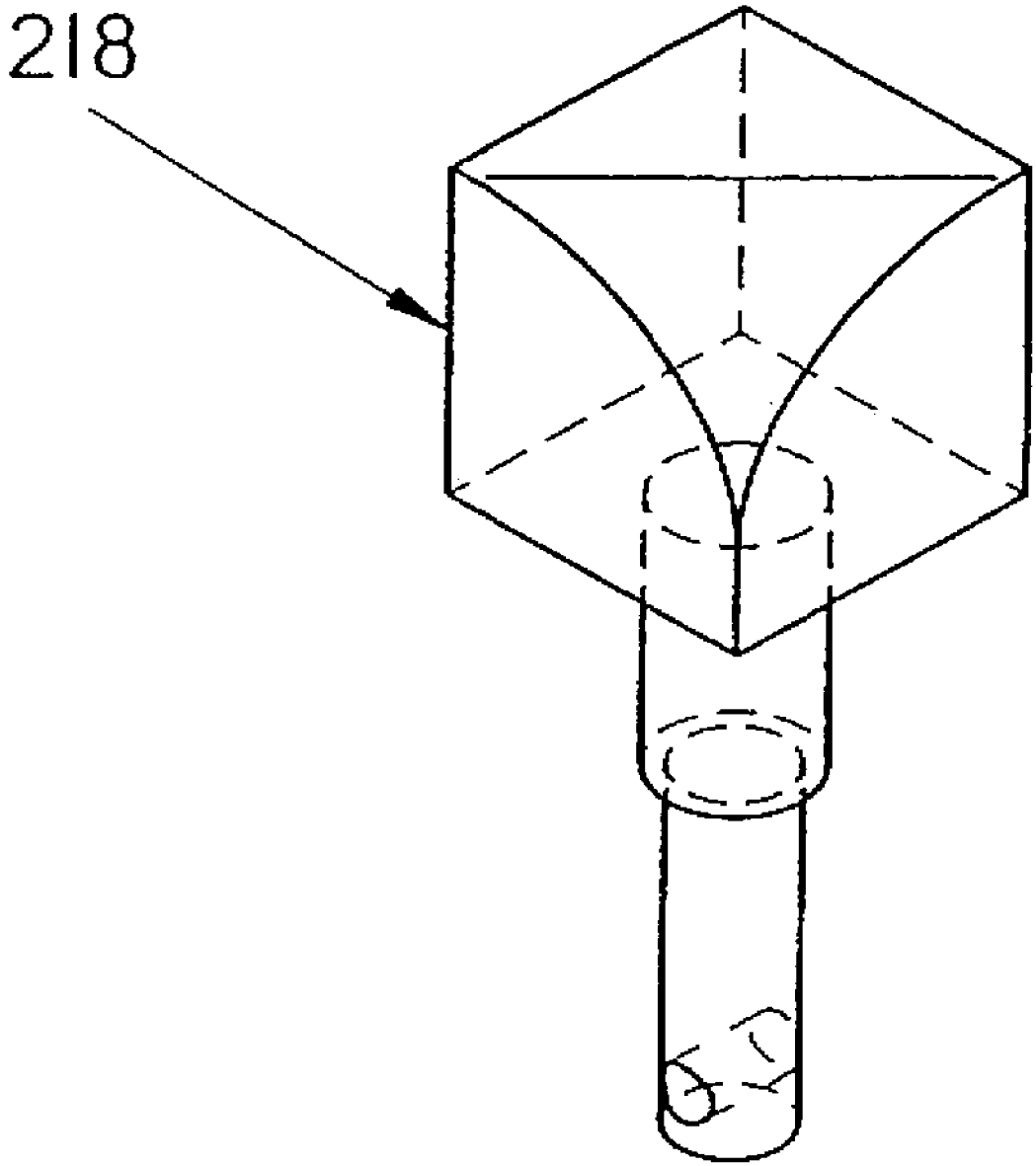
FIG. 24 is an enlarged perspective view of the handle release of the carrying rack of FIGS. 17-21.

Referring now to FIGS. 15 and 16, use of carrying rack 100 with a charged and uncharged hose is provided. Hoses 10, 20 are offered to illustrate the configuration of uncharged or empty hoses 10 and charged or full hoses 20. As seen in FIG. 11, an empty or uncharged hose 11 is supported by carrying rack 100. In an uncharged state, fire hose 12 remains flattened and may be more easily transported. As seen in FIG. 12, a full or charged fire hose 20 is supported by carrying rack 100. Unlike conventional carrying and/or storage devices for supporting a fire hose, fire hose 20 does not need to be removed from carrying rack 100 before charging the line. Fire hoses 10, 20 are shown as individual loops rather than as one continuous hose. The connection and/or nozzle ends of the fire hoses are not shown. Fire hoses 10 or 20 may be completely or selectively removed from carrying rack 100.

Referring now to FIGS. 17-24, another embodiment of the present disclosure is shown generally as hose rack 200. Hose rack 200 is substantially similar to hose rack 100 and will only be described as relates to the differences therebetween. Similar to hose rack 100, hose rack 200 includes first and second base members 202, 204, a handle or locking bar 210 operatively supported in first base member 202, a locking pin 208 supported in first base member 202 and operatively associated with locking bar 210, and a handle release 218 supported in and extending from first base member 202 and operatively associated with locking bar 210 and biased to an extended position.

First and second base members 202, 204 of rack 200 are preferably formed by injection molding. First and second base members 202, 204 include reinforced edges 202*a*, 204*b*, respectively. Reinforced edges 202*a*, 204*a* extend about the perimeter of members 202, 204 and about openings 205 formed therein. Reinforced edges 202*a*, 204*a* reinforce members 202, 204 and permit the use of less material in forming hose rack 200 while maintaining strength and rigidity thereof. By reducing the amount of material necessary to construct first and second members 202, 204, the overall weight hose rack 200 is also reduced. The use of hardened plastic also increases the durability of first and second members 202, 204.

With reference now to FIGS. 25-30, yet another embodiment of a hose carrying rack of the present disclosure is shown generally as hose rack 300. Hose rack 300 is substantially similar to hose racks 100, 200, including first and second base members 302, 304, a hinge mechanism 303, and a locking mechanism 306.

Figure 26:
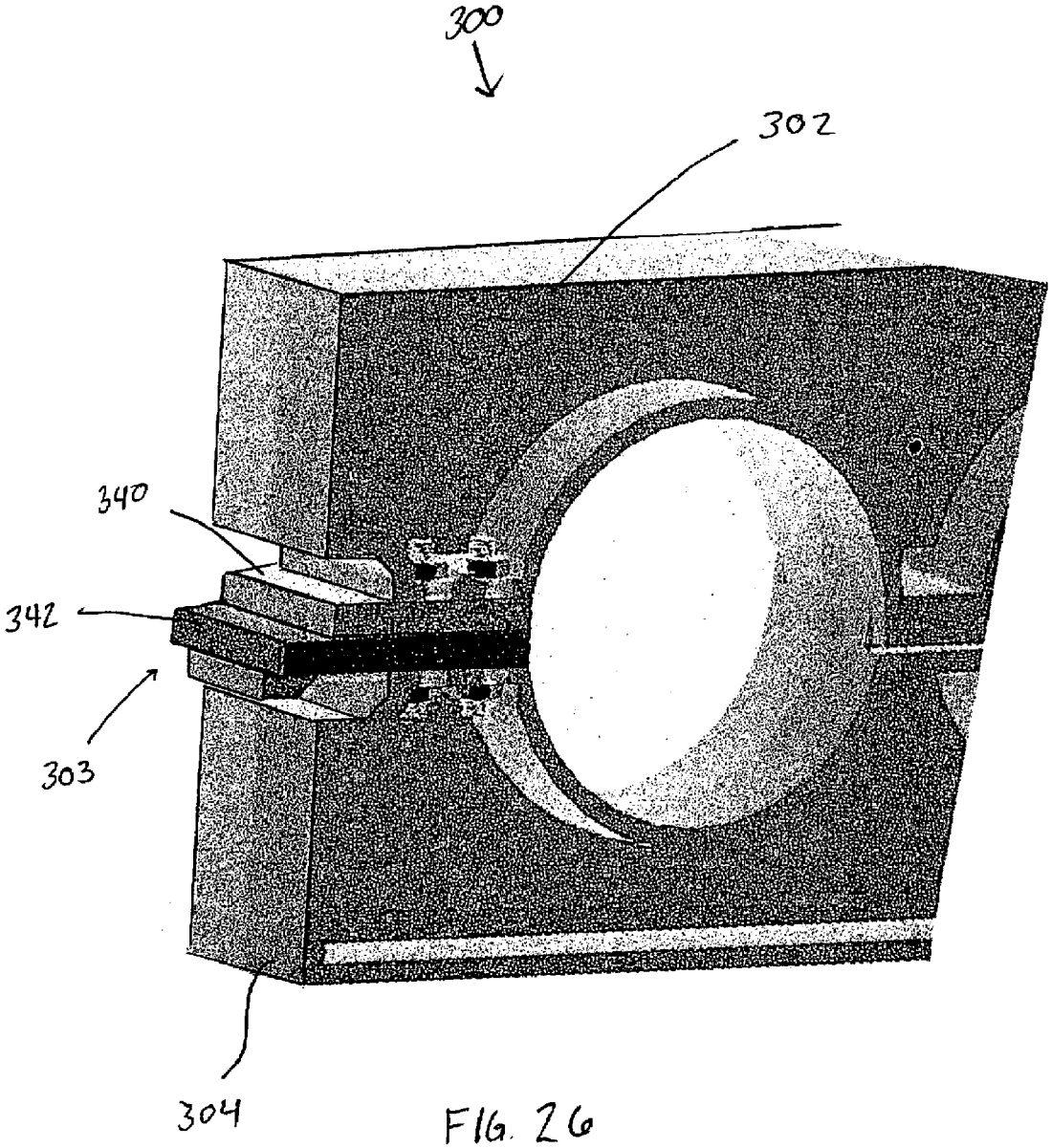
FIG. 26 is a perspective view of an end of the carrying rack of FIG. 25, illustrating a hinge mechanism thereof.
Figure 27:
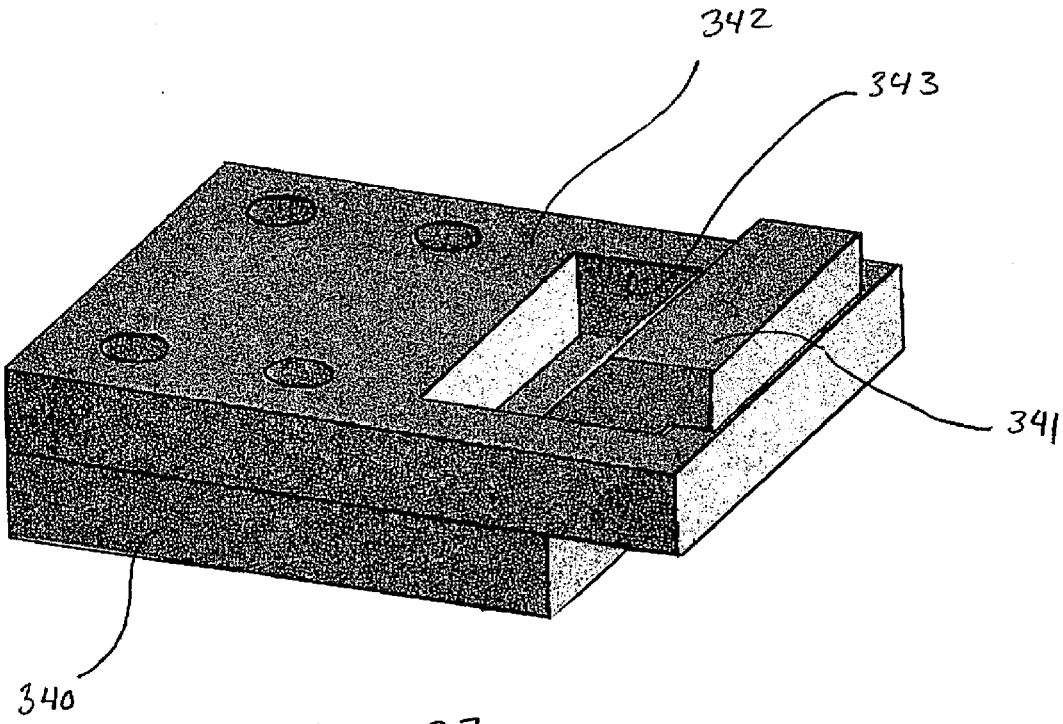
FIG. 27 is a perspective view of the hinge mechanism of FIG. 26 in a first or locked position.
Figure 28:
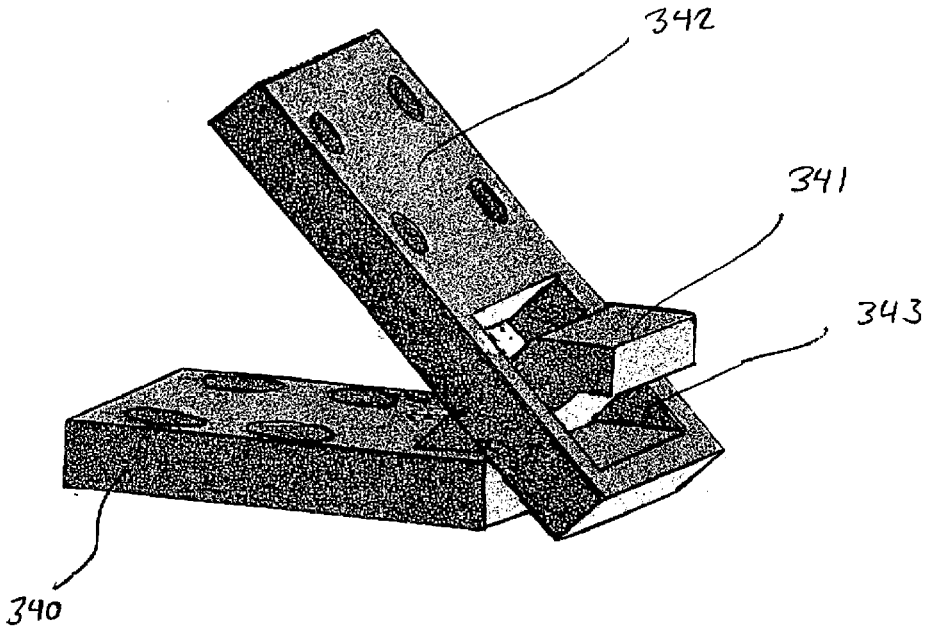
FIG. 28 is a perspective view of the hinge mechanism of FIGS. 26 and 27 in a second or unlocked position.

Turning to FIGS. 26-28, hinge mechanism 303 includes a first hinge portion 340 and a second hinge portion 342. First and second hinge portions 340, 342 are securely affixed to respective first and second base members 302, 304. As shown, first and second hinge portions 340, 342 may be secured to respective base members 302, 304 using screws, as shown, or with glue, bonding, welding, mechanical fasteners or other suitable means. In an alternative embodiment, hinge portions 340, 342 may be integrally formed with respective first and second base members 302, 304.

With particular reference now to FIGS. 27 and 28, first and second hinge portions 340, 342 of hinge mechanism 303 are configured to be selectively engaged with one another. First hinge portion 340 includes a flange 341 extending outwardly therefrom in the form of a goose-neck. Flange 341 is configured to selectively engage an opening 343 formed in second hinge portion 342. Hinge mechanism 303 operates in a similar manner as hinge 103 described hereinabove.

Figure 25:
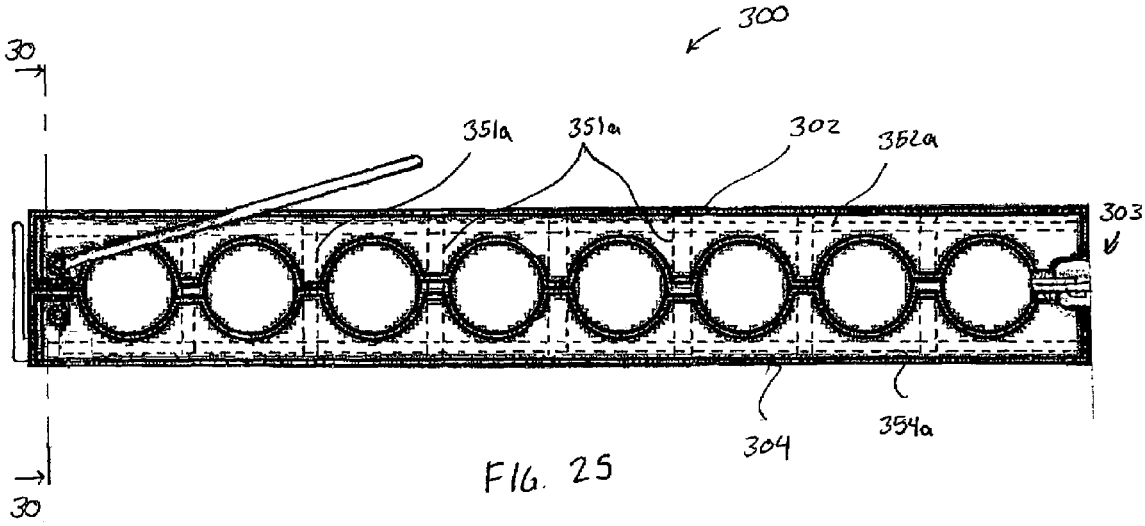
FIG. 25 is a side view of another carrying rack according to an embodiment of the present disclosure.
Figure 29:
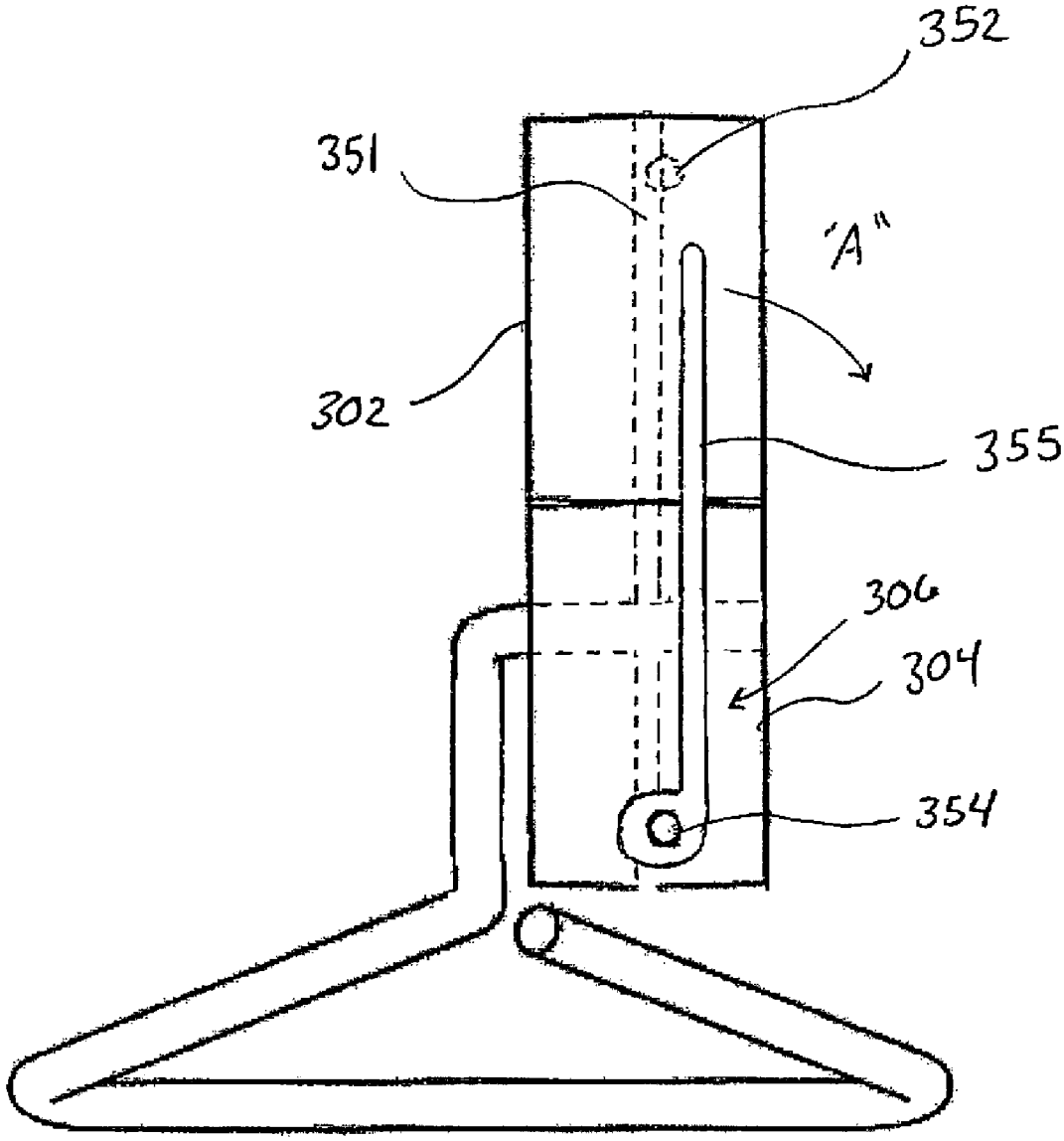
FIG. 29 is an end view of the carrying rack of FIG. 25.
Figure 30:
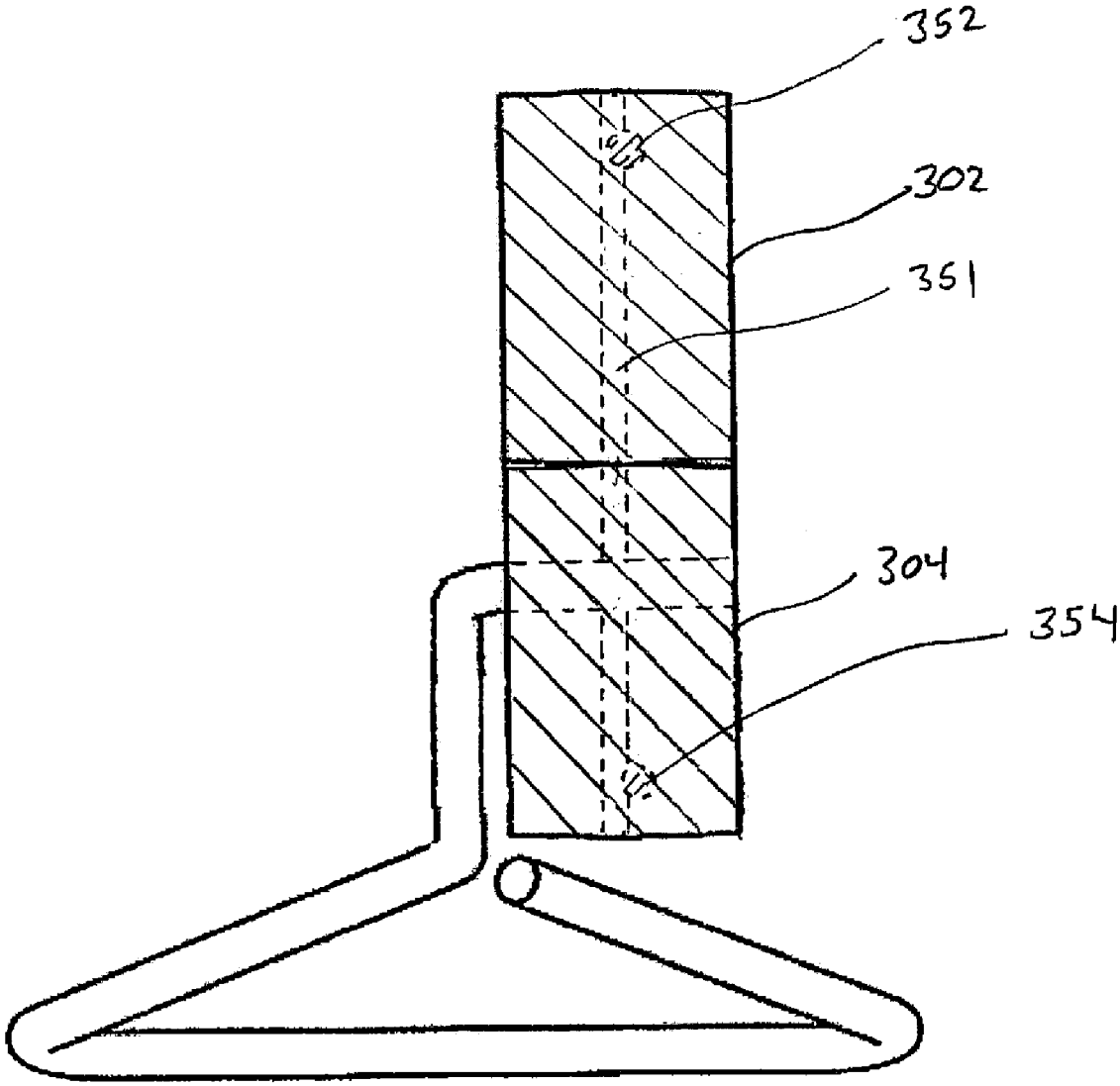
FIG. 30 is cross-sectional end view of the carrying rack of FIG. 25 taken along line 30-30 of FIG. 25.

Turning to FIGS. 25, 29 and 30, locking mechanism 306 is substantially similar in form and function to locking mechanism 106 described herein above. Locking mechanism 306 includes a plurality of pins 351 extending from first base member 302 into second base member 304 when first and second base members are received adjacent to one another. Pins 351 are retained within passages 351*a* formed in first base member 302 by a first locking rod 352 extending longitudinally through passage 352*a* formed in first base member 302. First locking rod 352 is configured to securely engage pins 351, thereby retaining pins 351 secure to first base member 302. A second locking rod 354 extends longitudinally through a second passage 354*a* formed in second base member 304 and is configured to selectively engage pins 351. Alternatively, first locking rod 352 may be received through passage 354*a* formed in second base member 304 and second locking rod 354 may be received through first base member 302. Second locking rod 354 includes a series of notches (not shown) corresponding to notches (not shown) formed on pins 351.

Initially the notches formed in second locking rod 354 are aligned with the notches formed on pins 351 to permit pins 351 to engage or fully enter passages 351*a* in second base member 304. A handle 355 is operably connected to an end of second locking rod 354 to permit rotation thereof. When second locking rod 354 is rotated in the direction of arrow "A" (as seen in FIG. 29), the notches formed in second locking rod 354 become misaligned with the notches formed in pins 351, thereby securing first and second base members 302, 304 together. Rotation of second locking rod 354 in a reverse direction re-aligns the notches of second locking rod 354 and pins 351 to enable disengagement of second locking rod 354 from pins 351. In an alternative embodiment, locking mechanism 306 may include a handle lock (not shown) to prevent unintentional rotation of second locking rod 354.

Figure 36A:
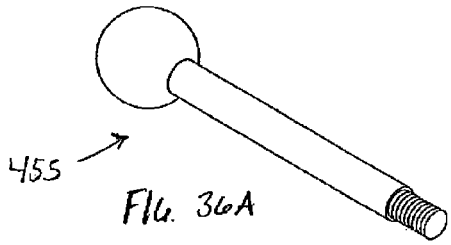
FIGS. 36A-36C are perspective (FIG. 36A), side (FIG. 36B) and end (FIG. 36C) views of a handle of the carrying rack of FIGS. 31A-31C.
Figure 36B:
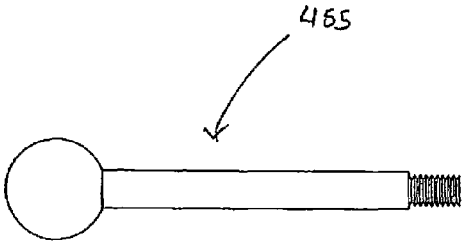
Figure 36C:
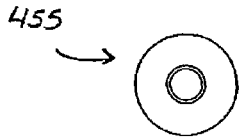
Figure 37:
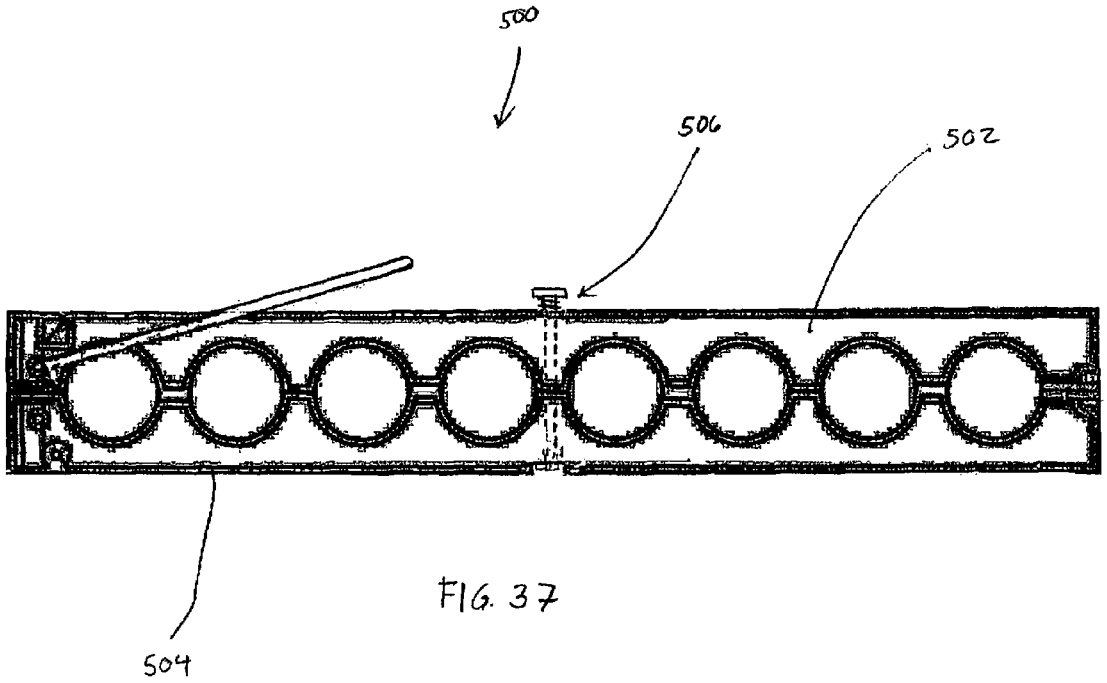
FIG. 37 is a side view of a carrying rack according to still yet another embodiment of the present disclosure.
Figure 39:
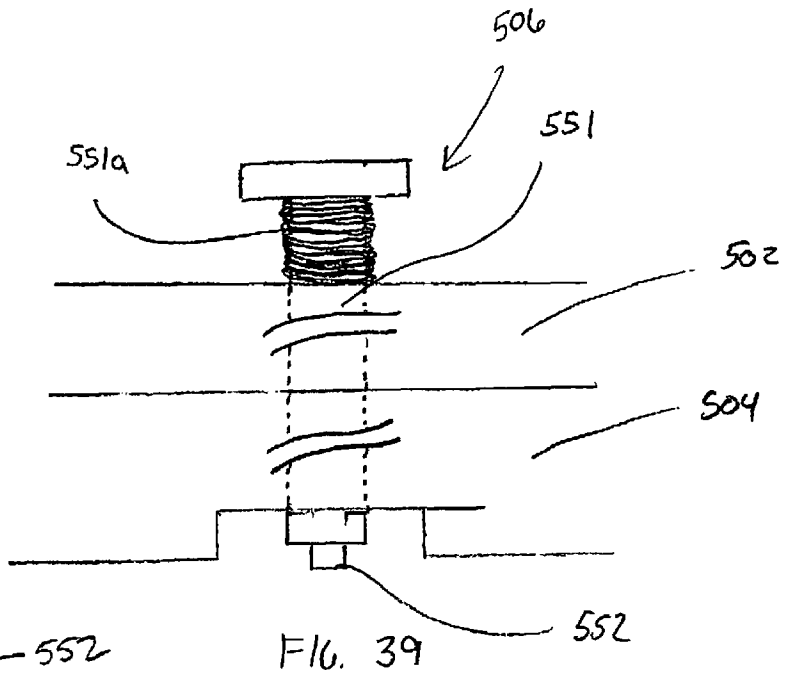
FIGS. 38 and 39 are side views of a locking mechanism of the carrying rack of FIG. 37.
Figure 40:
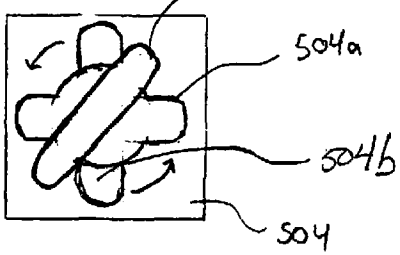
FIG. 40 is a bottom view of the locking mechanism of FIGS. 38 and 39.
Figure 38:
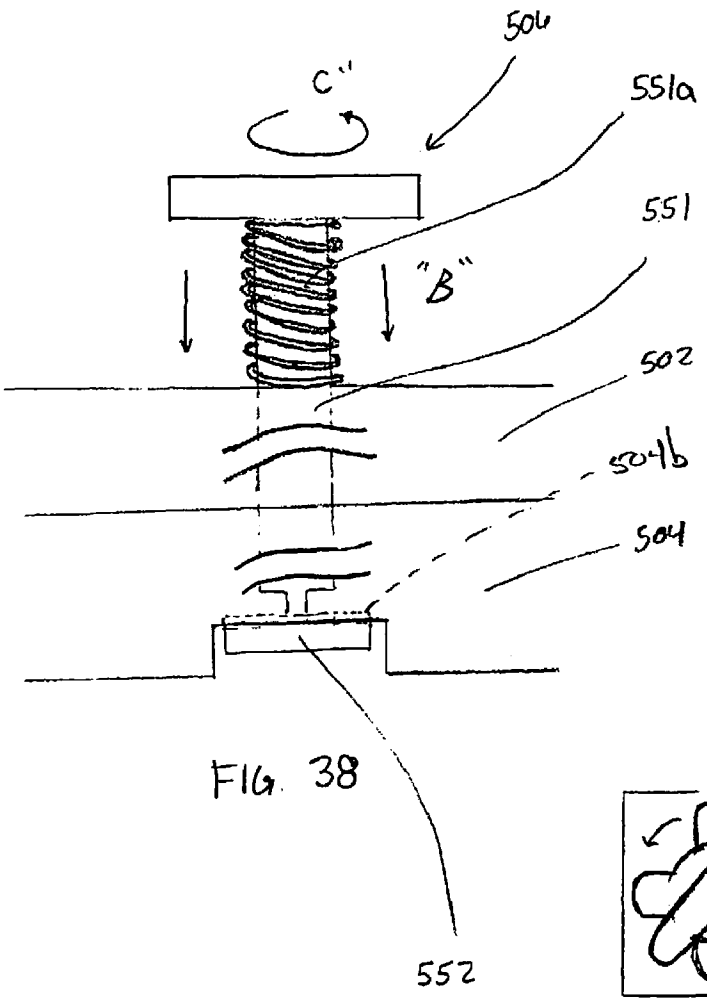

Turning to FIGS. 31A-36C, disassembled components of still yet another embodiment of a hose carrying rack according to the present disclosure are shown. The carrying rack is substantially similar to carrying racks 100, 200, 300 described hereinabove. The carrying rack includes first and second base members 402, 404 (FIGS. 31A-31C), a first locking rod 452 (FIGS. 32A and 32B), a second locking rod 454 (FIGS. 33A-33E), a handle member 410 (FIG. 34A-34F), a plurality of pins 451 (FIGS. 35A-35E), and a handle 455 (FIGS. 36A-36C).

Figure 31B:
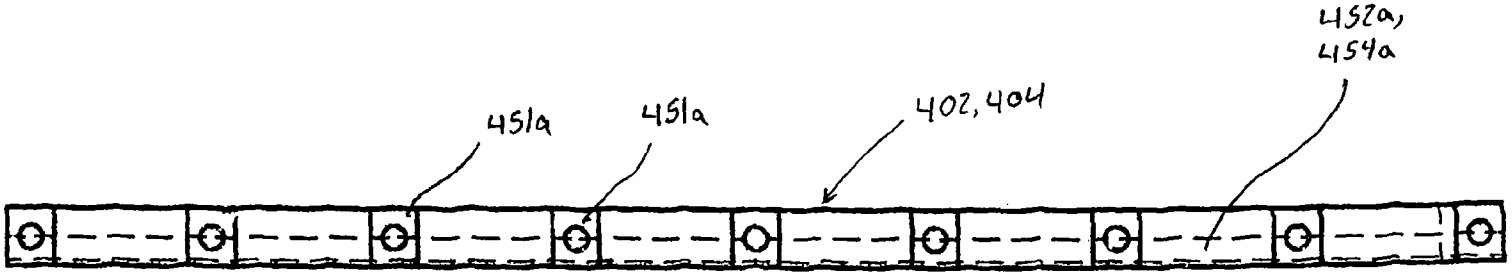
FIGS. 31A-31C are side (FIG. 31A), top (FIG. 31B) and end (FIG. 31C) views of a base member according to an alternate embodiment of a carrying rack of the present disclosure.
Figure 31A:
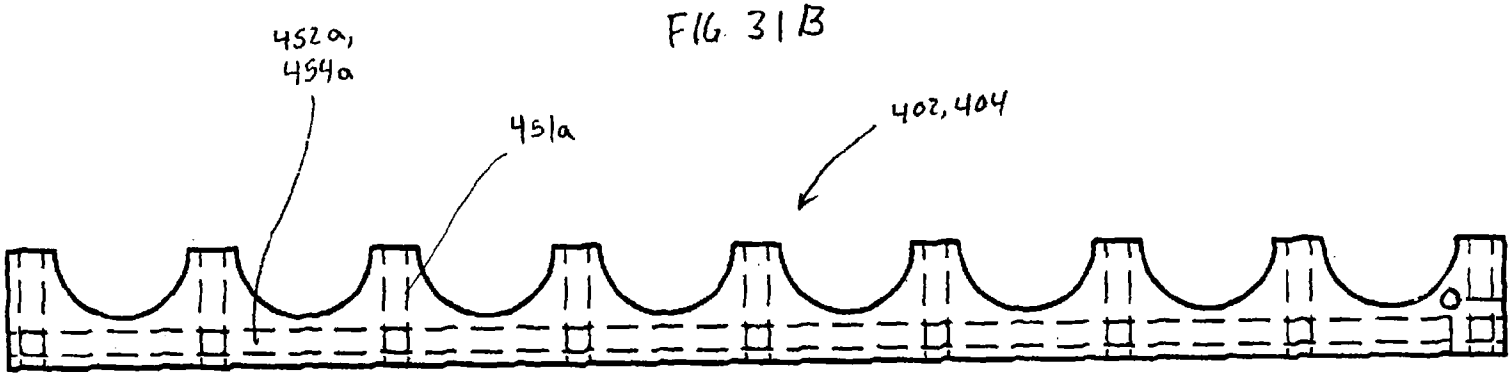
Figure 31C:
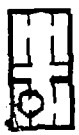
Figure 32A:
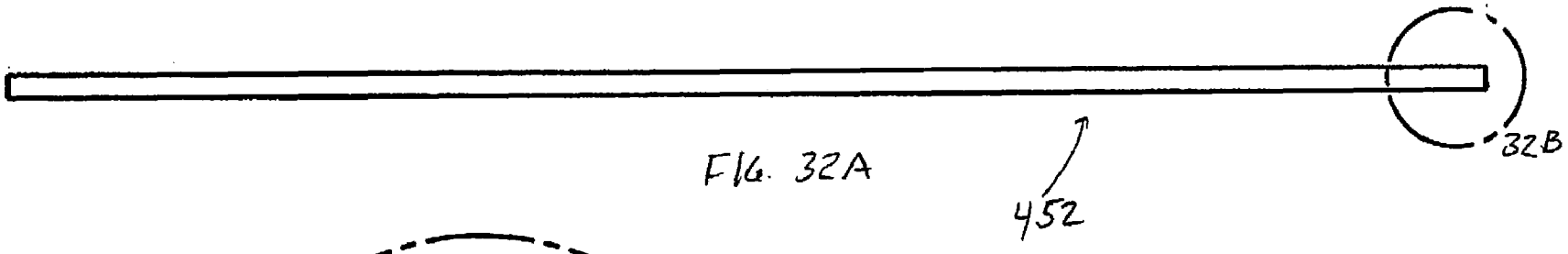
FIG. 32A is a top view of a first locking/reinforcing rod of the carrying rack of FIGS. 31A-31C.
Figure 32B:
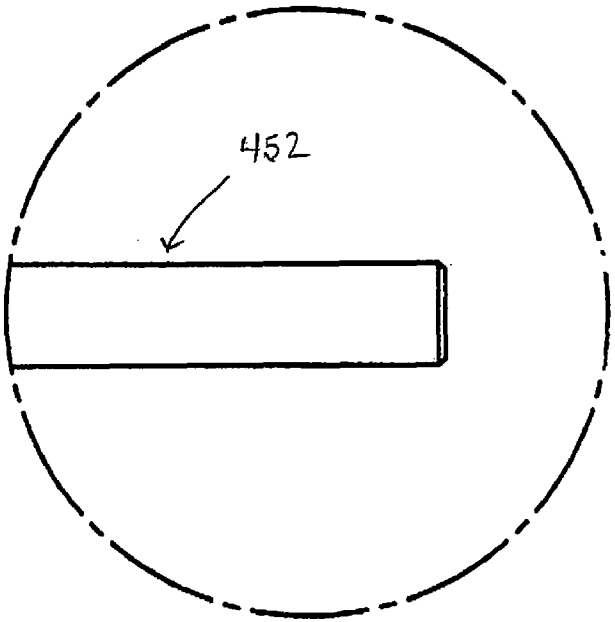
FIG. 32B is an enlarged view of portion 32B of FIG. 32A.
Figures 33A, 33B, 33C, 33D, 33E:
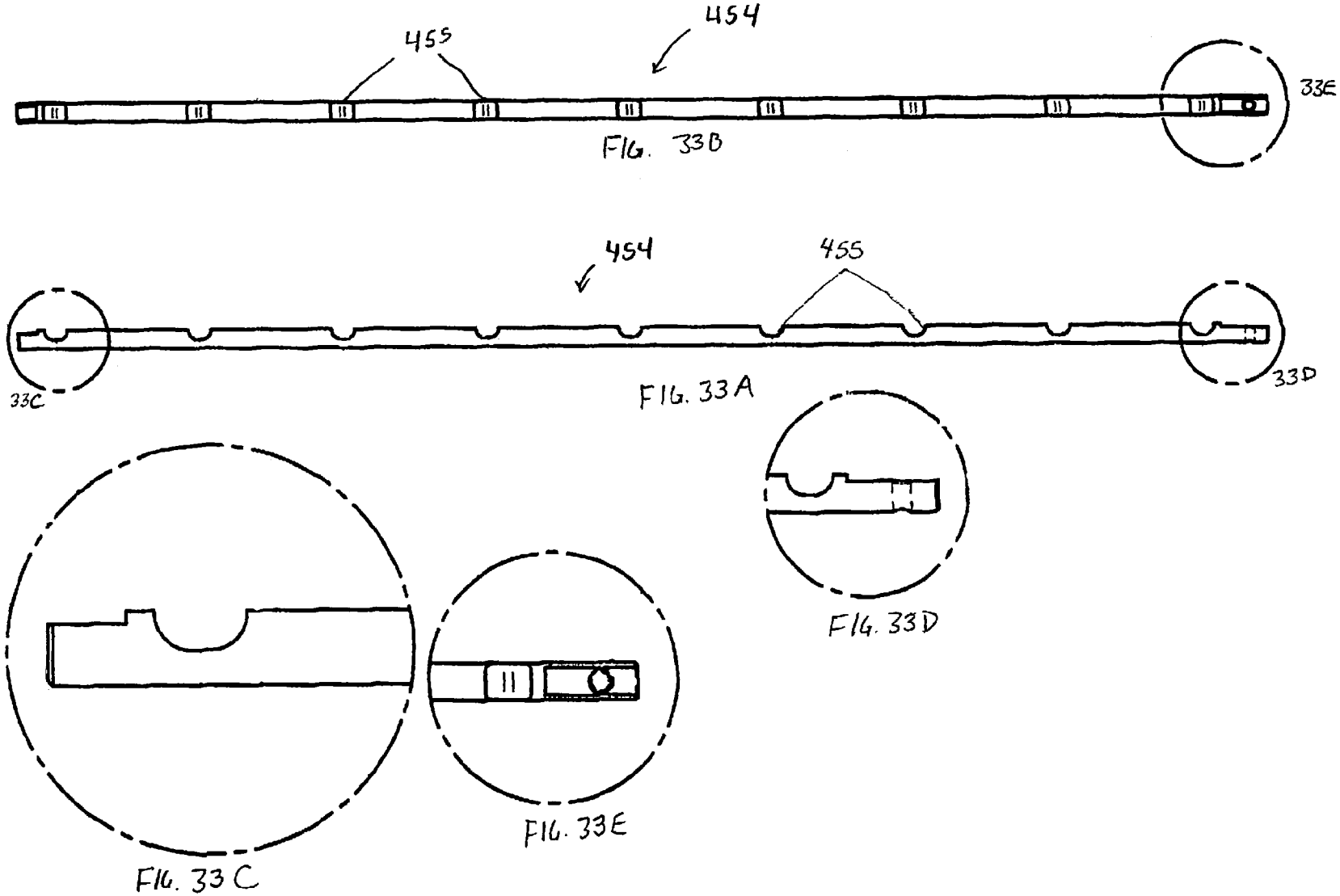
FIG. 33A is a top view of a second locking/reinforcing rod of the carrying rack of FIGS. 31A-31C.
FIG. 33B is a side view of the second locking rod of FIG. 33A.
FIGS. 33C and 33D are enlarged views of portions 33C and 33D of FIG. 33A.
FIG. 33E is an enlarged view of portion 33E of FIG. 33B.
Figure 34A:
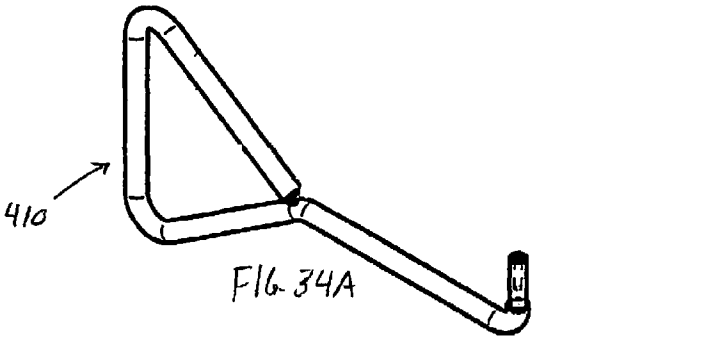
FIGS. 34A-34D are perspective (FIG. 34A), side (FIG. 34B), top (FIG. 34C) and end (FIG. 34D) views of a handle member of the carrying rack of FIGS. 31A-31C.
Figure 34E:
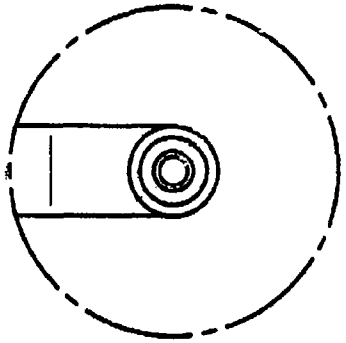
FIG. 34E is an enlarged view of portion 34E of FIG. 34B.
Figure 34D:
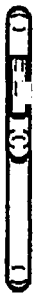
Figure 34B:
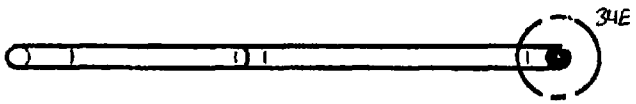
Figure 34C:
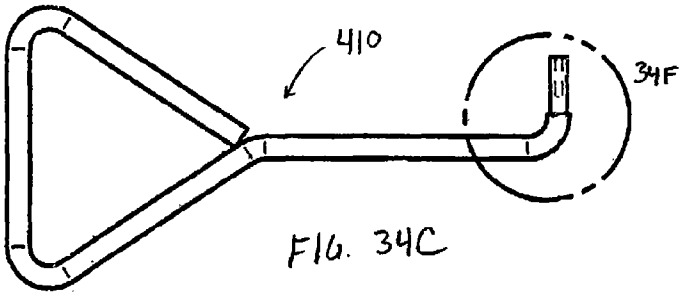
Figure 34F:
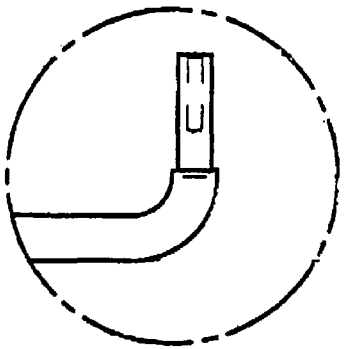
FIG. 34F is an enlarged view of portion 34F of FIG. 34C.

Referring initially to FIGS. 31A-31C, first and second base members 402, 404 are substantially identical. Base members 402, 404 include longitudinal passage 452*a*, 454*a*, respectively, configured to received first locking rod 452 (FIGS. 32A and 32B) and second locking rods 454 (FIGS. 33A-33E), respectively. Each of base members 402, 404 further include a lateral passage 451*a* configured to receive pins 451 (FIGS. 35A-35E). Turning to FIGS. 33A-33E, second locking rod 454 includes a plurality of notches 455 extending along the length thereof configured to engage a first notch 453*a* formed on pin 451. With references to FIGS. 35A-35E, pin 451 includes a second notch 453*b* formed opposite first notch 453*a*. Second notch 453*b* is configured to engage first locking rod 452.

With reference now to FIGS. 37-40, a further embodiment of a hose carrying rack according to the present disclosure is shown generally as carrying rack 500. Carrying rack 500 includes locking mechanism 506. Although shown located in the center of first and second base members 502, 504, locking mechanism 506 may be formed anywhere along the length thereof. In an alternative embodiment, carrying rack 500 may include a plurality of locking mechanisms 506 formed along a length thereof to selectively secure second base member 504 to first base member 502.

With reference still to FIGS. 37-40, locking mechanism 506 includes a pin 551 extending from first base member 502 through second base member 504. Pin 551 is rotatable secured to first base member 502 and is configured to be selectively secured within an elongated opening or slot 504*a* formed in second base member 504. A spring 551*a* biases pin 551 within first base member 502. Pin 551 includes a flanged end 552 configured to be selectively received within slot 504*a* formed in second base member 504. In a first position (FIG. 38), flanged end 552 of pin 551 is aligned with slot 504*a* formed in second base member 504 such that first base member 502 may be received adjacent to second base member 504. Depression of pin 551 in the direction indicated by arrow "B" and rotation of pin 551 ninety degrees (90°) in the direction indicated by arrow "C" (FIG. 38) causes flange 552 of pin 551 to become misaligned with slot 504*a*, thereby securely engaging flange 552 within slot 504*a* of second base member 504. Continued rotation of pin 551 within slot 504*a* will realign flange 552 with slot 504*a*, thereby disengaging flange 552 from second base member 504 and permitting separation of first and second base members 502, 504.

It is further contemplated that an elongate channel 504*b* (See FIG. 40) may be formed in second base member 504 and be substantially orthogonally oriented with respect to slot 504*a* so as for receiving flange 552 therein when locking mechanism 506 is misaligned from slot 504*a*. It is envisioned that channel 504*b* may be provided with sloped surfaces (not shown) against which flange 552 will engage as spring 551*a* expands to thereby automatically rotate locking mechanism 506 to the fully locked position.

Thus, it should be understood that various changes in form, detail and operation of the carrying rack of the present disclosure may be made without departing from the spirit and scope of the present disclosure.

What I claim is:

1. A carrying rack for supporting a charged hose, the rack comprising:

a first body member having a first end and a second end;

a second body member having a first end and a second end;

a hinge connecting the first end of the first body member to the first end of the second body member, the hinge including:

a hinge bar secured to one of the first body and the second body; and a hinge hook configured to selectively engage the hinge bar, wherein the hinge hook engages the hinge bar when the first body and the second body are in an approximated condition to maintain the carrying rack in a closed condition; and wherein the hinge hook and the hinge bar of the hinge are configured to permit complete disconnection of the first body member from the second body member upon a pivotable separation of the first body member from the second body member when the rack is in an open condition, wherein the first and second body members define recesses configured for receiving a charged hose; and a locking mechanism extending between the first body member and the second body member for selectively locking the first body member to the second body member and maintaining the rack in a closed condition, wherein the locking mechanism is rotatable between a locking position for maintaining the rack in a closed condition and a releasing position permitting an opening of the rack.

2. The carrying rack of claim 1, wherein the locking mechanism is rotatably supported in one of the first body member and the second body member, and wherein the locking mechanism is rotatable between the locking position and the releasing position;

wherein, in the locking position, the locking mechanism extends into the other of the first body member and the second body member, and in the releasing position, the locking mechanism does not extend into the other of the first body member and the second body member.

3. The carrying rack of claim 1, wherein the hinge selectively interconnects the first and second body members.

4. The carrying rack of claim 1, wherein the first and second body members are injection molded.

5. The carrying rack of claim 1, further comprising a breakaway hinge having a first hinge member secured to the first body member and a second hinge member secured to the second body member, wherein the first and second hinge members are releasably engageable with one another, and wherein the hinge is configured to permit complete separation of the first body member from the second body member.

* * * * *